US009452916B2

(12) United States Patent
Bond

(10) Patent No.: US 9,452,916 B2
(45) Date of Patent: Sep. 27, 2016

(54) ELECTRICALLY NON-CONDUCTIVE CALIBRATED MECHANICAL WINCH AND METHOD OF MANUFACTURE

(71) Applicant: Lonnie Mark Bond, Marietta, OK (US)

(72) Inventor: Lonnie Mark Bond, Marietta, OK (US)

(73) Assignee: Zantho Tools LLC, Marietta, OK (US)

( * ) Notice: Subject to any disclaimer, the term of this patent is extended or adjusted under 35 U.S.C. 154(b) by 158 days.

(21) Appl. No.: 14/049,641

(22) Filed: Oct. 9, 2013

(65) Prior Publication Data

US 2014/0070152 A1 Mar. 13, 2014

Related U.S. Application Data

(63) Continuation-in-part of application No. 13/451,341, filed on Apr. 19, 2012, now abandoned.

(60) Provisional application No. 61/711,443, filed on Oct. 9, 2012, provisional application No. 61/477,223, filed on Apr. 20, 2011, provisional application No. 61/548,938, filed on Oct. 19, 2011, provisional application No. 61/577,503, filed on Dec. 19, 2011, provisional application No. 61/615,729, filed on Mar. 26, 2012.

(51) Int. Cl.

| | |
|---|---|
| ***B21F 9/00*** | (2006.01) |
| ***B66F 3/00*** | (2006.01) |
| ***B66D 5/24*** | (2006.01) |
| ***B66D 1/04*** | (2006.01) |
| ***B25B 25/00*** | (2006.01) |

(52) U.S. Cl.
CPC ..... *B66D 5/24* (2013.01); *B25B 25/00* (2013.01); *B66D 1/04* (2013.01)

(58) Field of Classification Search
CPC ... B66D 3/02; B66D 3/14; B66D 2700/0116
USPC ..... 254/217, 218, 222, 223, 237, 238, 239, 254/243; 24/68 R
See application file for complete search history.

(56) References Cited

U.S. PATENT DOCUMENTS

| | | | |
|---|---|---|---|
| 3,722,267 | A | 3/1973 | Gordon |
| 3,762,777 | A | 10/1973 | Jacob et al. |
| 3,791,210 | A | 2/1974 | Taylor |
| 3,988,007 | A | 10/1976 | Freiburger, Jr. |
| 4,226,405 | A | 10/1980 | Roodt |
| 4,235,420 | A | 11/1980 | Ross et al. |
| 4,408,925 | A | 10/1983 | Louie |
| 4,542,883 | A | 9/1985 | Rutzki |
| 5,295,664 | A | 3/1994 | Kamper |
| 5,339,767 | A | 8/1994 | Krag |

(Continued)

OTHER PUBLICATIONS

Copenheaver, Blaine R., "International Search Report" for PCT/US2012/034280 as mailed Jul. 3, 2012, 2 pages.

*Primary Examiner* — Emmanuel M Marcelo
(74) *Attorney, Agent, or Firm* — Winstead PC

(57) ABSTRACT

In one aspect, the present invention relates to a mechanical winch. The mechanical winch includes a body and a spool axle. The spool axle is slidably disposed within the body and coupled to the body by at least one spring. A spool is disposed about the spool axle. A non-electrically-conductive tether is coupled to the spool. A brake axle is slidably disposed within the frame and located a fixed distance from the spool axle. Actuation of the spool applies increasing tension to non-electrically-conductive tether and causes compression of the at least one spring.

6 Claims, 44 Drawing Sheets

(56) References Cited

U.S. PATENT DOCUMENTS

| | | | |
|---|---|---|---|
| 5,485,762 | A | 1/1996 | Rothman |
| 5,954,041 | A | 9/1999 | Sands |
| 6,007,053 | A | 12/1999 | Huang |
| 6,279,415 | B1 | 8/2001 | Chance et al. |
| 6,908,073 | B1 | 6/2005 | Hsien |
| 6,973,852 | B2 | 12/2005 | Shin et al. |
| 7,219,396 | B2 | 5/2007 | Hsieh |
| 7,350,768 | B1 | 4/2008 | Chang |
| 7,448,598 | B1 | 11/2008 | Elmlinger et al. |
| 7,509,711 | B2 | 3/2009 | Hsieh |
| 7,762,531 | B2 | 7/2010 | Bond |
| 2006/0011380 | A1 | 1/2006 | Pierce |
| 2006/0117901 | A1 | 6/2006 | Owyang |
| 2007/0022675 | A1 | 2/2007 | Weisman |
| 2008/0115716 | A1 | 5/2008 | Wrage |
| 2008/0172843 | A1 | 7/2008 | Shimanski |
| 2009/0250543 | A1 | 10/2009 | Bond |

ELECTRICALLY NON-CONDUCTIVE CALIBRATED MECHANICAL WINCH AND METHOD OF MANUFACTURE

CROSS-REFERENCE TO RELATED APPLICATIONS

This application is a continuation-in-part of U.S. patent application Ser. No. 13/451,341, filed Apr. 19, 2012. U.S. patent application Ser. No. 13/451,341 claims priority to, and incorporates by reference the entire disclosure of, U.S. Provisional Patent Application No. 61/477,223, filed Apr. 20, 2011, U.S. Provisional Patent Application No. 61/548,938, filed Oct. 19, 2011, U.S. Provisional Patent Application No. 61/577,503, filed Dec. 19, 2011, and U.S. Provisional Patent Application No. 61/615,729, filed Mar. 26, 2012.

This application claims priority to, and incorporates by reference the entire disclosure of, U.S. Provisional Patent Application No. 61/711,443, filed Oct. 9, 2012. This application incorporates by reference the entire disclosure of U.S. Provisional Patent Application No. 61/477,223, U.S. Provisional Patent Application No. 61/548,938, U.S. Provisional Patent Application No. 61/577,503, U.S. Provisional Patent Application No. 61/615,729, and U.S. Pat. No. 7,762,531, filed Apr. 3, 2009.

BACKGROUND

1. Field of the Invention

The present invention relates to a calibrated mechanical winch, and more particularly, but not by way of limitation, to a calibrated mechanical winch, constructed at least in part of a non-electrically conductive material, that allows users to ascertain a general level of tension applied to a wire, cable, rope, or other tensionable element.

2. History of the Related Art

Many devices have been used for tensioning cables, wires, and other tensionable elements. Electrically-charged objects such as, for example, power-transmission wires, require specialized equipment for safe tensioning.

Equipment utilized for tensioning of metallic objects such as, for example electrical transmission wires, often requires specialized instrumentation for determining a precise magnitude of tension applied. For example, objects constructed of metallic materials have a known thermal coefficient of expansion. Such objects expand and contract as ambient temperature rises or falls. If, for example, a metallic wire is installed during summer at a select tension, when ambient temperature drops in autumn and winter, the metallic wire contracts, thereby increasing a tensile load on the metallic wire. Such an increased load may result in the metallic wire breaking. For this reason, it is important to determine how much tension, relative to the ambient temperature, has been placed upon a wire, cable, rope, or other tensionable element during tensioning.

Tensioning of electrical-transmission wires is not the only application where cables, wires, ropes, and other tensionable elements require stretching. When erecting vertical structures, such as radio or television antenna towers, wire stays or the like are often used. Tensioning devices must be incorporated in such applications in order to avoid risk of property damage and personal injury should a magnitude of tension applied to the wire stay fall outside of an engineering specification.

In particular, equipment utilized for tensioning electrically-charged objects must be constructed of electrically non-conductive materials. Use of electrically non-conductive materials allows mechanical interaction with electrically-charged objects while protecting the user from electrical shock.

SUMMARY

The present invention relates to a calibrated mechanical winch, and more particularly, but not by way of limitation, to a calibrated mechanical winch, constructed at least in part of a non-electrically-conductive material, that allows users to ascertain a general level of tension applied to a wire, cable, rope or other tensionable element. In one aspect, the present invention relates to a mechanical winch. The mechanical winch includes a body and a spool axle. The spool axle is slidably disposed within the body and coupled to the body by at least one spring. A spool is disposed about the spool axle. A non-electrically-conductive tether is coupled to the spool. A brake axle is slidably disposed within the frame and located a fixed distance from the spool axle. Actuation of the spool applies increasing tension to non-electrically-conductive tether and causes compression of the at least one spring.

In another aspect, the present invention relates to another embodiment of a mechanical winch. The mechanical winch includes a body and a spool support assembly slidably disposed within the body. The spool-support assembly includes a spool rotatably coupled in the spool support assembly and having a tether secured therearound. The spool is disposed between a pair of ratchet wheels. The spool support assembly also includes a handle pivotably coupled to the body and operable to impart force to the ratchet wheels to induce rotation of the spool. An adjustable stop is coupled to the spool-support assembly. The adjustable stop has an associated adjustment member. A spring is operatively engaged with the body and the spool-support assembly. An indicator is disposed in the body and removably restrained by the adjustable stop. Application of tension to the tether displaces the spool support assembly causing compression of the spring. Displacement of the spool support assembly results in disengagement of the indicator from the adjustable stop.

In another aspect, the present invention relates to another embodiment of a mechanical winch. The mechanical winch includes a body and a spool rotatably coupled in the body and having a tether secured therearound. The spool is coupled to a ratchet wheel. A handle is pivotably coupled to the body and operable to impart force to the ratchet wheel to induce rotation of the spool. A cylinder is coupled to the body and includes a piston and a spring disposed therein. The spring is arranged to engage the piston.

In another aspect, the present invention relates to a method of applying tension to a tensionable element. The method includes providing a mechanical winch having first, second, and third couplers, connecting the first coupler to a first support, and connecting a first pulley to a second support. The method further includes connecting a second pulley to the third coupler, attaching a first end of the tensionable element to a tether coupled to the mechanical winch, and attaching a second end of the tensionable element to the second support. The method further includes applying tension to the tensionable element via actuation of the mechanical winch and compressing a spring located in the mechanical winch responsive to the tension applied to the tensionable element.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
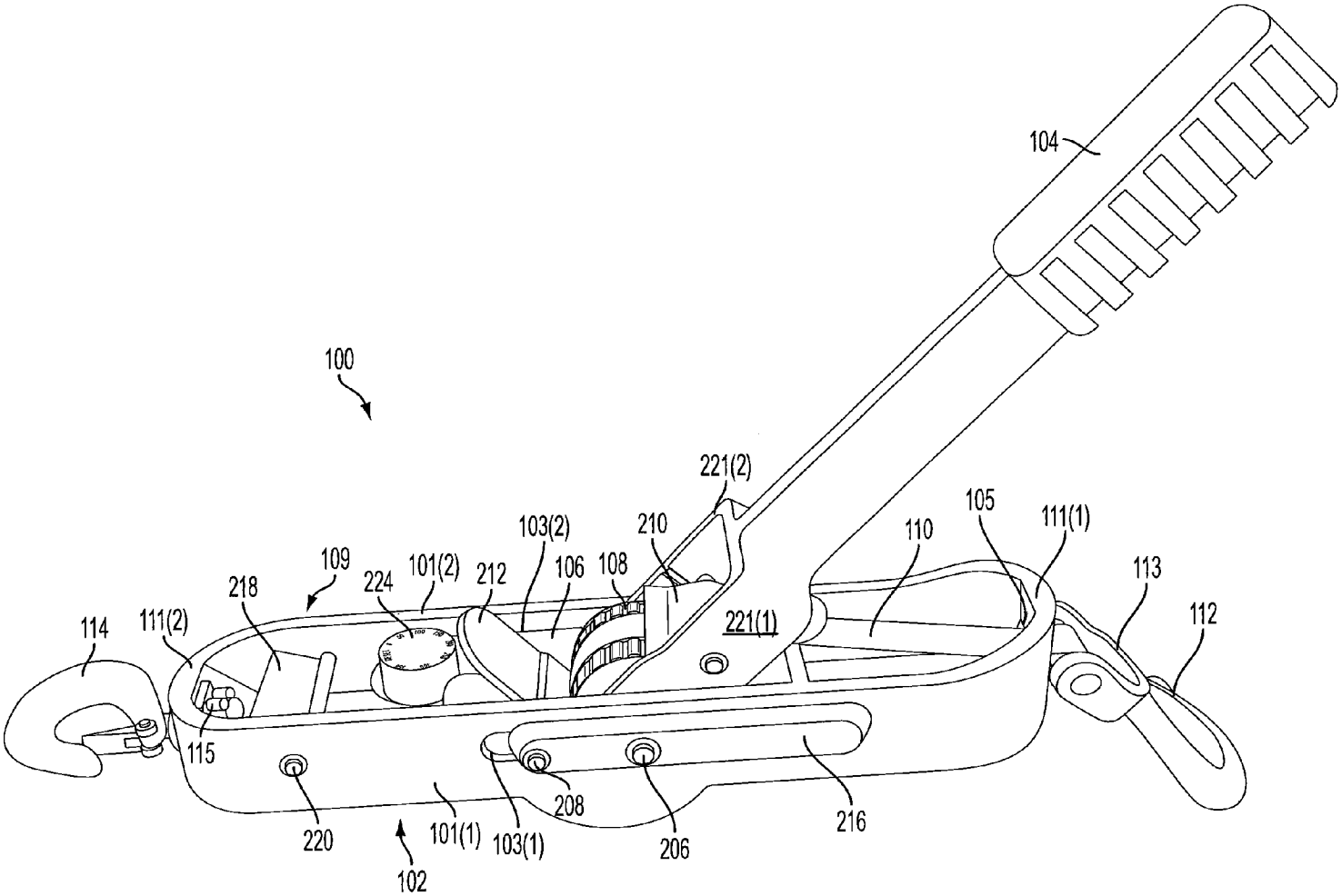
FIG. 1 is a perspective view of a first embodiment of a mechanical winch.

FIG. 1 is a perspective view of a first embodiment of a mechanical winch 100. The mechanical winch 100 includes a body 102, a handle 104 pivotably coupled to the body 102, an indicator assembly 109 disposed in the body 102, a spool-support assembly 106 slidably disposed within the body 102, a spool 108 rotatably disposed within the spool-support assembly 106, a tether 110 secured about the spool 108, a first connector 112, and a second connector 114. In a typical embodiment, the body 102 is constructed of a non-electrically-conductive material such as, for example, plastic, Kevlar, fiberglass, or another non-electrically-conductive material. Use of non-electrically-conductive material allows the mechanical winch 100 to be utilized in applications involving tensioning of electrically-charged objects such as, for example, electrical-transmission wires and the like. The body 102 is formed into a substantially ovoid shape having generally parallel sides 101(1) and 101(2) and rounded ends 111(1) and 111(2). In other embodiments, a mechanical winch utilizing principles of the invention may include a body formed into any other appropriate shape, such as, for example, rectangular and the like. A first slot 103(1) is formed on the generally parallel side 101(1) and a second slot 103(2) is formed on the generally parallel side 101(2).

The spool-support assembly 106 slidably engages with the first slot 103(1) and the second slot 103(2). The tether 110, typically constructed of a non-absorbent, non-electrically-conductive material, is secured about the spool 108. In a typical embodiment, the tether 110 may comprise, for example, a cable, a wire, a rope, a strap, or the like. The tether 110 passes through an opening 105 formed in the rounded end 111(1). The first connector 112 is coupled to an end of the tether 110 by a first swivel 113 and the second connector 114 is coupled to the rounded end 111(2) by a second swivel 115. In other embodiments, a third connector (not shown) may be coupled to the body 102 on the rounded end 111(1). In a typical embodiment, the first connector 112 and the second connector 114 are constructed generally of a non-electrically-conductive material such as, for example, plastic, Kevlar, fiberglass or other non-electrically-conductive material.

Figure 2A:
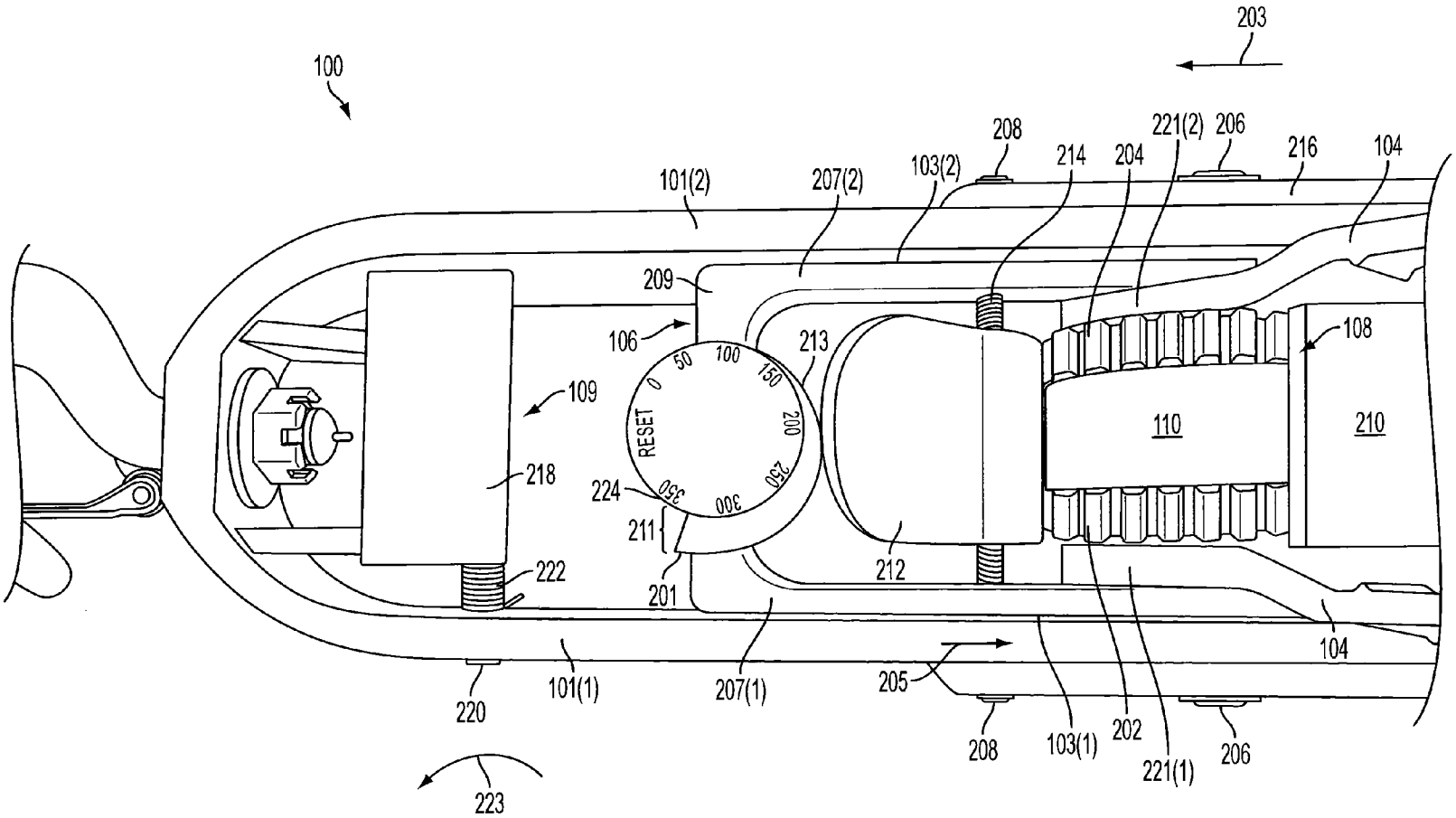
FIG. 2A is a detailed partial top view illustrating a proximal aspect of the mechanical winch of FIG. 1.

FIG. 2A is a detailed partial top view illustrating a proximal aspect of the mechanical winch 100. The spool 108 includes a first ratchet wheel 202 and a second ratchet wheel 204 disposed on opposite sides of the spool 108. The spool-support assembly 106 includes a first side member 207(1), a second side member 207(2) oriented generally parallel to the first side member 207(1), and a cross member 209 disposed between, and coupled to, the first side member 207(1) and the second side member 207(2). At least a portion of the first side member 207(1) is disposed in the first slot 103(1) and at least a portion of the second side member 207(2) is disposed in the second slot 103(2).

The spool-support assembly 106 includes an indicator dial 224 disposed on the cross member 209. The indicator dial 224 has indicia printed thereon that are used to select a desired magnitude of tension to be applied to the tether 110. An indicator lobe 201 is disposed below the indicator dial 224. The indicator lobe 201 is cam-lobe shaped and includes an area of maximum width 211 and an area of minimum width 213 generally corresponding to the indicia printed on the indicator dial 224.

Figure 2B:
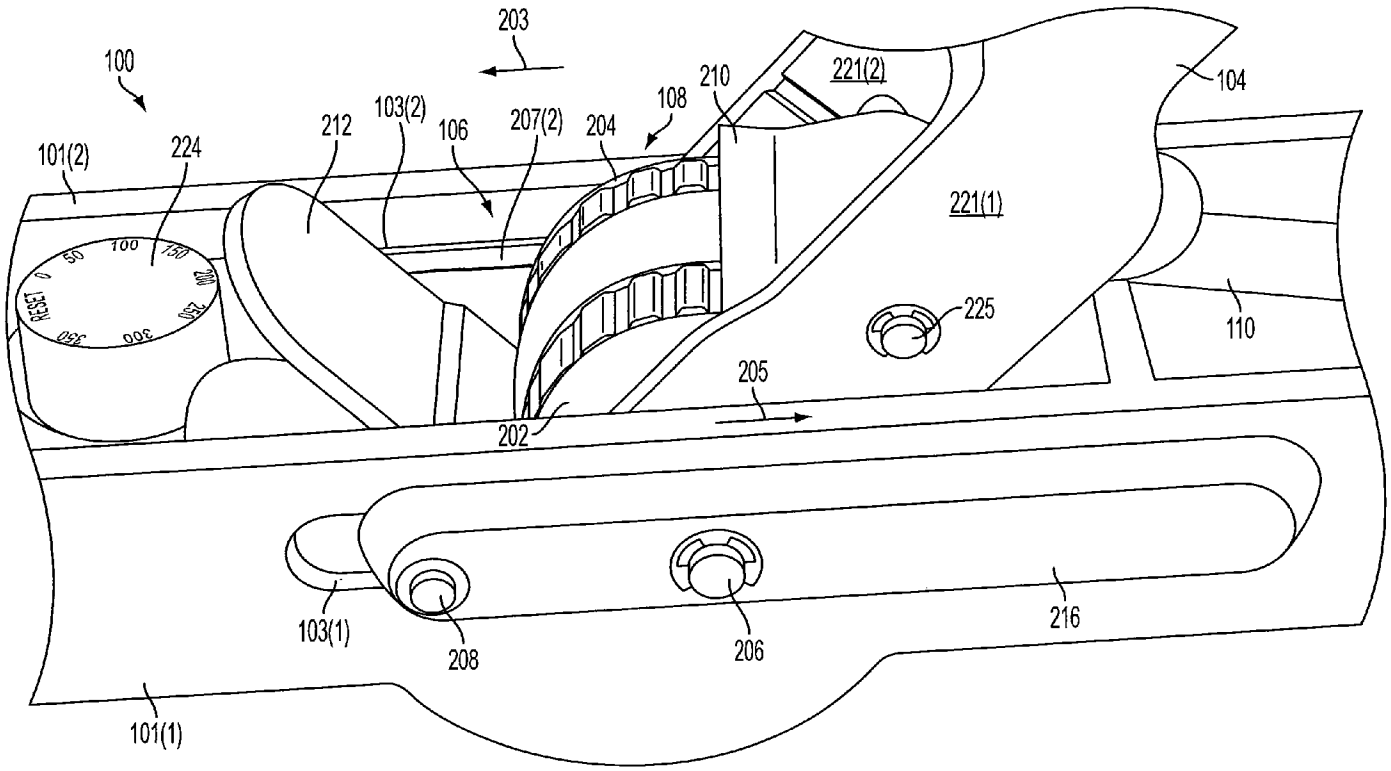
FIG. 2B is a detailed partial perspective view illustrating a central aspect of the mechanical winch of FIG. 1.

FIG. 2B is a detailed partial perspective view illustrating a central aspect of the mechanical winch 100. The spool-support assembly 106 includes a first axle 206 and a second axle 208. The first axle 206 and the second axle 208 extend through the first side member 207(1) (shown in FIG. 2A) and the second side member 207(2). The first axle 206 and the second axle 208 are disposed generally parallel to each other between, and generally orthogonally to, the first side member 207(1) and the second side member 207(2). A pair of side caps 216 are disposed over ends of the first axle 206 and the second axle 208 to secure the spool-support assembly 106 within the first slot 103(1) and the second slot 103(2).

The handle 104 includes a pair of opposing arms 221(1) and 221(2) and a drive-pawl axle 225 extending between, and generally orthogonal to, the pair of opposing arms 221(1) and 221(2). A drive pawl 210 is disposed between the pair of opposing arms 221(1) and 221(2) about the drive-pawl axle 225. By way of example, the handle 104 is depicted in FIGS. 1-2B as being in a first position such that the handle 104 is angled toward a distal end of the mechanical winch 100.

Referring back to FIG. 2A, a brake pawl 212 is disposed on the second axle 208 between the first side member 207(1) and the second side member 207(2) at a position proximal to the first axle 206. The brake pawl 212 is biased to engage the first ratchet wheel 202 and the second ratchet wheel 204 by a brake-pawl spring 214. Interaction of the brake pawl 212 with the first ratchet wheel 202 and the second ratchet wheel 204 prevents unwinding of the spool 108 when the handle 104 is actuated in a direction opposite a direction illustrated by the arrow 203.

The spool 108 and the handle 104 are pivotably coupled to the spool-support assembly 106 by the first axle 206. The spool 108 is disposed between the pair of opposing arms 221(1) and 221(2) of the handle 104. The drive pawl 210 is biased to engage the first ratchet wheel 202 and the second ratchet wheel 204 by a drive-pawl spring 304 (shown in FIG. 3). Interaction of the drive pawl 210 with the first ratchet wheel 202 and the second ratchet wheel 204 imparts motion to the spool 108 when the handle is actuated in the direction illustrated by the arrow 203.

The indicator assembly 109 includes a third axle 220 disposed between the generally parallel sides 101(1) and 101(2) at a position proximal to the second axle 208 and adjacent to the indicator dial 224. An indicator 218 and an indicator spring 222 are disposed on the third axle 220. The indicator 218 is biased by the indicator spring 222 in a direction indicated by the arrow 223.

Figure 3:
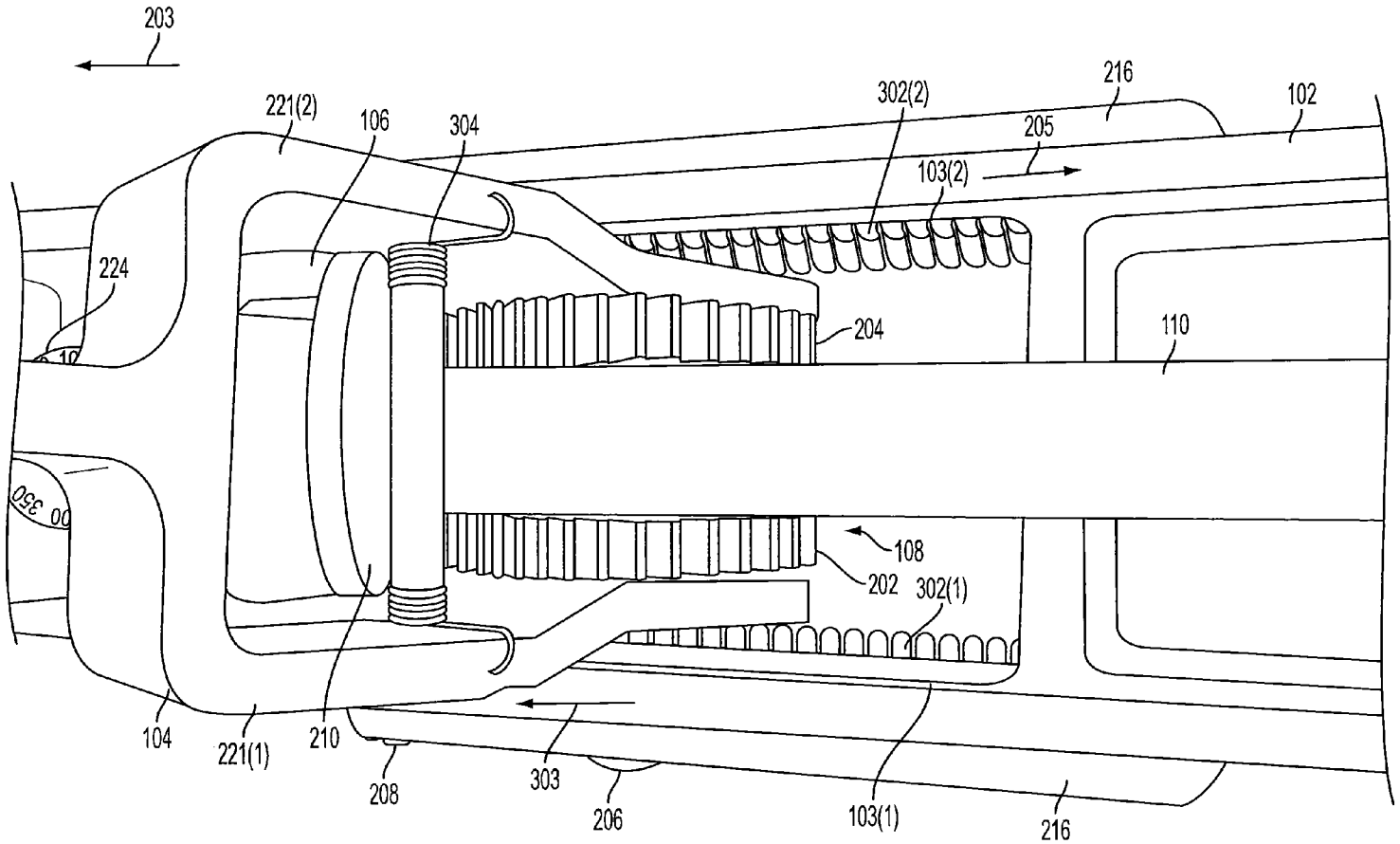
FIG. 3 is a detailed partial top view illustrating a distal aspect of the mechanical winch of FIG. 1.

FIG. 3 is a detailed partial top view illustrating a distal aspect of the mechanical winch 100. In FIG. 3, the handle 104 has been partially actuated to a second position proximal to the first position illustrated in FIGS. 1-2B. The drive-pawl spring 304 is disposed between the pair of opposing arms 221(1) and 221(2) of the handle 104 and biases the drive pawl 210 to engage the first ratchet wheel 202 and the second ratchet wheel 204. A first spring 302(1) is disposed in the first slot 103(1) and a second spring 302(2) is disposed in the second slot 103(2). The first spring 302(1) engages the body 102 and the first side member 207(1), and the second spring 302(2) engages the body 102 and the second side member 207(2). The first spring 302(1) and the second spring 302(2) bias the spool-support assembly 106 in a direction indicated by the arrow 303. A mechanical winch utilizing principles of the present invention may include springs of various types such as, for example, a hydraulic cylinder, a Nitrogen-gas spring, or a die spring. In a typical embodiment, the first spring 302(1) and the second spring 302(2) are constructed of, or coated with, a non-electrically-conductive material such as, for example, Kevlar; however, in other embodiments, the first spring 302(1) and the second spring 302(2) may be constructed from other materials including, for example, metallic materials. In a typical embodiment, the first spring 302(1) and the second spring 302(2) are removable and interchangeable.

Referring now to FIGS. 2A and 3, the tether 110 is connected to a load (not shown). When the handle 104 is rotated in the direction indicated by the arrow 203, the rotation of the handle 104 causes the drive pawl 210 to engage the first ratchet wheel 202 and the second ratchet wheel 204 thereby causing the spool 108 to rotate. As the spool 108 rotates, the tether 110 becomes increasingly wound around the spool 108, thereby increasing a magnitude of tension applied to the tether 110. As the magnitude of tension applied to the tether 110 increases, the spool-support assembly 106 moves in a direction indicated by the arrow 205, thereby compressing the first spring 302(1) and the second spring 302(2).

Figure 4:
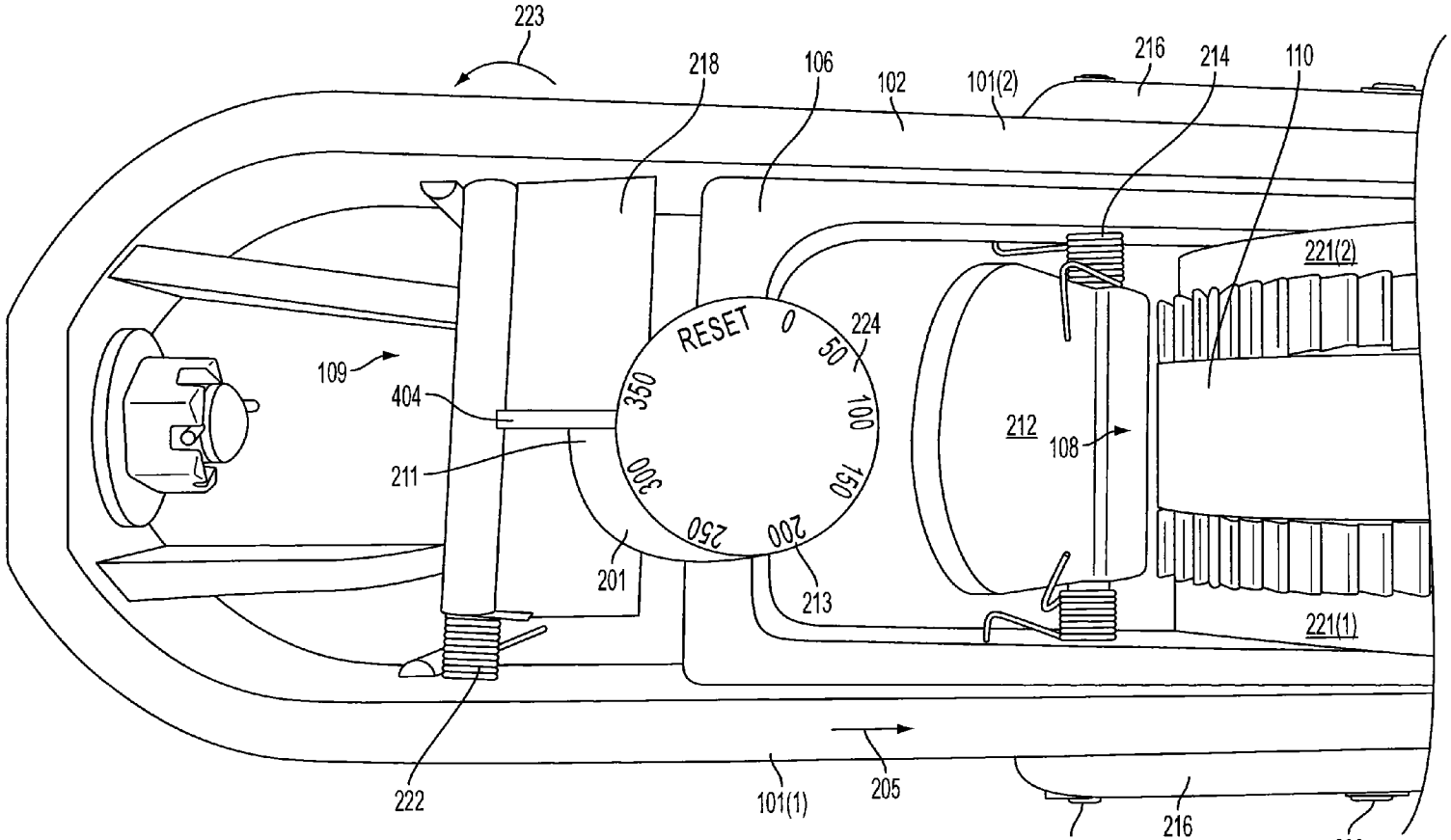
FIG. 4 is a detailed partial top view of the proximal aspect of the mechanical winch of FIG. 1 illustrating an indicator assembly.

FIG. 4 is a detailed partial top view of the proximal aspect of the mechanical winch 100 and illustrating the indicator assembly 109 in more detail. During operation, the indicator 218 is first rotated in a direction opposite that of the arrow 223. The indicator dial 224 is rotated until the desired magnitude of tension, as indicated by the indicia, aligns with a marker 404 printed on the indicator 218. Rotation of the indicator dial 224 increases or decreases an exposed width of the indicator lobe 201, thereby adjusting a magnitude of tension required to disengage the indictor 218 from the indicator lobe 201. By way of example, if a large amount of tension is to be applied to the tether 110, the indictor dial 224 may be adjusted to expose a greater width of the indictor lobe 201. On the other hand, if a small amount of tension is to be applied to the tether 110, the indictor dial 224 may be adjusted to expose a shorter width of the indicator lobe 201.

The indicator lobe 201 engages the indicator 218 and prevents the indicator 218 from moving in the direction indicated by the arrow 223. As a magnitude of tension applied to the tether 110 increases, the spool-support assembly 106 moves in the direction indicated by the arrow 205.

When the desired magnitude of tension is reached, the indicator lobe 201 disengages from the indicator 218, thereby allowing the indicator 218 to rotate in the direction indicated by the arrow 223. Movement of the indicator 218 provides a visual indication that the desired magnitude of tension has been reached. In other embodiments, a chime may be coupled to the body 102. In such embodiments, the indicator 218 strikes the chime upon becoming disengaged from the indicator lobe 201 and causes the chime to emit an audible tone that signals that the desired level of tension has been reached. In other embodiments, mechanical winches of the present invention may utilize other visual or audible alerts to signal that the desired magnitude of tension has been reached.

Figure 5:
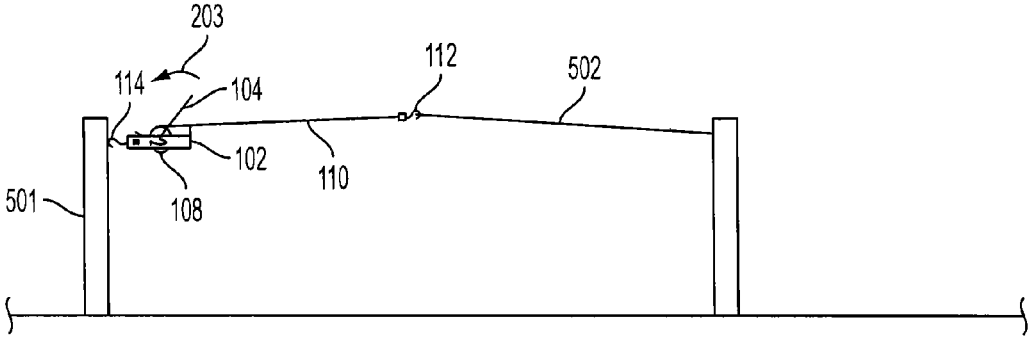
FIG. 5 is a schematic diagram illustrating operation of the mechanical winch of FIG. 1.

FIG. 5 is a schematic diagram that illustrates operation of the mechanical winch 100. The second connector 114 is coupled to a support, shown by way of example in FIG. 5 to be a fence post 501. The first connector 112 is coupled to a length of cable, wire, or other tensionable element to be tensioned. By way of example, the first connector 112 is shown coupled to a length of wire 502.

Referring now to FIGS. 1-5, when the handle 104 is actuated in the direction noted by arrow 203, the drive pawl 210 engages the first ratchet wheel 202 and the second ratchet wheel 204 and causes the spool 108 to rotate in the same direction as the handle 104. As the spool 108 rotates, the tether 110 is wound around the spool 108. When the handle 104 is actuated in a direction opposite that illustrated by the arrow 203, the drive pawl 210 does not engage, and does not impart motion to, the first ratchet wheel 202 and the second ratchet wheel 204. In this situation, the brake pawl 212 engages the first ratchet wheel 202 and the second ratchet wheel 204, and prevents the spool 108 from unwinding thereby releasing any tension applied to the tether 110. Thus, repeated arcuate movements of the handle 104 result in the tether 110 becoming increasingly wound around the spool 108 and incrementally greater tension being applied to the length of wire 502.

As a magnitude of tension applied to the length of wire 502 increases, the spool-support assembly 106 slides within the body 102 in a direction denoted by arrow 205. This motion compresses the first spring 302(1) and the second spring 302(2). As the spool-support assembly 106 slides in the direction denoted by the arrow 205, a constant distance is maintained between the first axle 206 and the second axle 208. Such an arrangement ensures that the brake pawl 212 remains engaged to the first ratchet wheel 202 and the second ratchet wheel 204, thus preventing an inadvertent release of tension.

The magnitude of tension applied to the length of wire 502 is determined through application of Hooke's Law ($F=-kx$), where F is a force applied, x is a linear deflection of the first spring 302(1) and the second spring 302(2) away from an equilibrium position, and k is a physical property of the first spring 302(1) and the second spring 302(2) known as a "force constant" or "spring constant." This property is commonly referred to as a "stiffness" of the first spring 302(1) and the second spring 302(2). The indicia is calibrated to the first spring 302(1) and the second spring 302(2) to measure tension as a function of deflection of the first spring 302(1) and the second spring 302(2).

When an operator desires to relieve tension applied to the length of wire 502, the operator fully actuates the handle 104 in the direction depicted by the arrow 203. If a large amount of tension has been applied to the length of wire 502, it is necessary to disengage the drive pawl 210 from the first ratchet wheel 202 and the second ratchet wheel 204. Such disengagement allows the handle 104 to rotate independently of the spool 108 without applying any additional tension to the length of wire 502. When the handle 104 has been fully actuated in the direction depicted by the arrow 203, the drive pawl 210 contacts the brake pawl 212. Interaction between the drive pawl 210 and the brake pawl 212 causes the brake pawl 212 to also become disengaged from the first ratchet wheel 202 and the second ratchet wheel 204. Disengagement of the drive pawl 210 and the brake pawl 212 allows the spool 108 to rotate freely and relieves tension applied to the length of wire 502.

Figure 6:
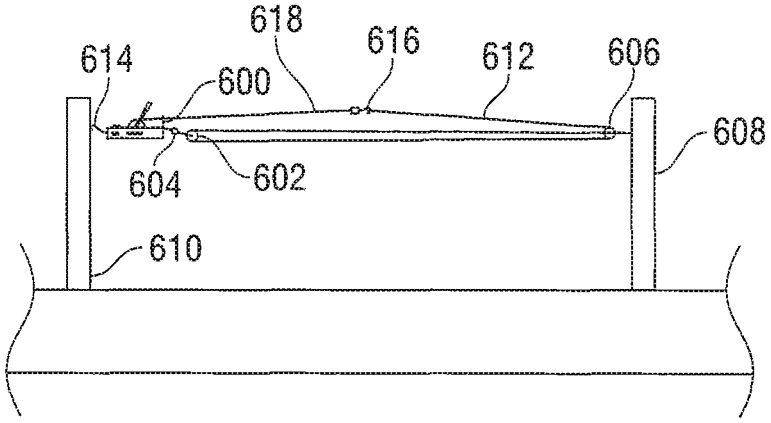
FIG. 6 is a schematic diagram illustrating operation of the mechanical winch of FIG. 1.

FIG. 6 is a schematic diagram illustrating operation of a mechanical winch 600. In various embodiments, the mechanical winch 600 is realized by adding a third connector 604 to the mechanical winch 100 as described above with respect to FIG. 1. The mechanical winch 600 is utilized in conjunction with a block-and-tackle pulley system. A first pulley 602 is coupled to the third connector 604. A second pulley 606 is coupled to an object such as, for example, a second fence post 608. The second connector 614 is coupled to a support such as, for example, a first fence post 610. The first connector 616 is coupled to a cable or other tensionable element 612 to be tensioned. A cable or other tensionable element 612 is wound around the first pulley 602 and the second pulley 606. The cable or other tensionable element 612 is tensioned as described above with respect to FIG. 5. In other embodiments, a tether 618 may be wound around the first pulley 602 and the second pulley 606.

Figure 7:
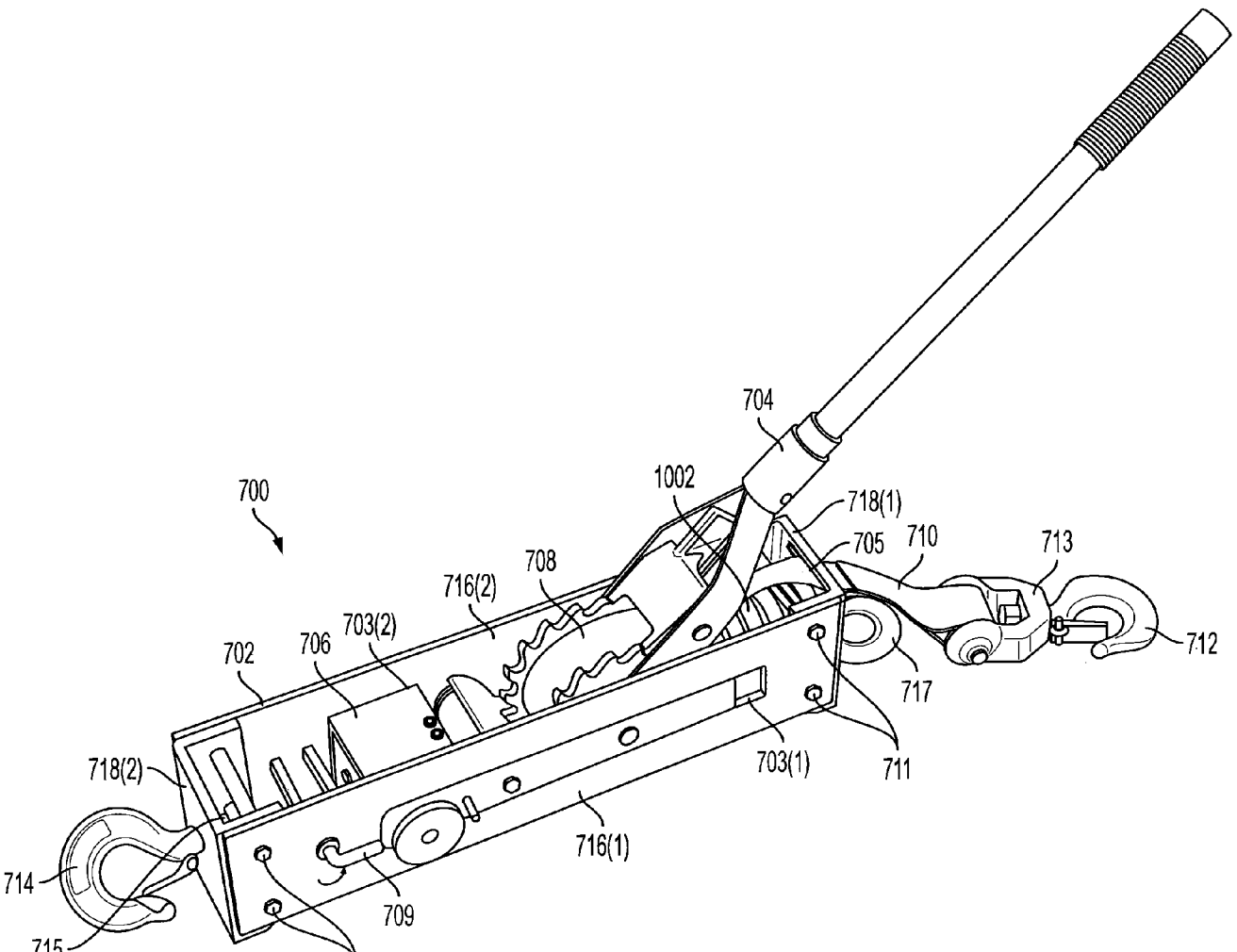
FIG. 7 is a perspective view of a second embodiment of a mechanical winch.

FIG. 7 is a perspective view of a second embodiment of a mechanical winch 700. The mechanical winch 700 comprises a body 702, an indicator assembly 709 disposed within the body 702, a spool-support assembly 706 slidably disposed within the body 702, a spring 1002 disposed between the body 702 and the spool-support assembly 706, a spool 708 rotatably disposed within the spool-support assembly 706, a tether 710 secured about the spool 708, a handle 704 pivotably coupled to the spool-support assembly 706, a first connector 712 coupled to the tether 710, and a second connector 714 coupled to the body 702. In a typical embodiment, the body 702 may be constructed of any appropriate material such as, for example, a non-electrically-conductive material. Use of non-electrically-conductive materials allows the mechanical winch 700 to be used in applications involving tensioning of electrically-charged objects such as, for example, electrical transmission wires and the like. The body 702 is formed into a generally rectangular shape and includes generally parallel sides 716(1)-716(2). The generally parallel sides 716(1)-716(2) are coupled to ends 718(1)-718(2) via, for example, a plurality of fasteners 711. However, one skilled in the art will recognize that the generally parallel sides 716(1)-716(2) and the ends 718(1)-718(2) may be joined through a process such as, for example, welding. In other embodiments, a mechanical winch utilizing principles of the invention may include a body constructed, for example, of a unitary piece of material formed into a generally rectangular shape. Further, in other embodiments, a mechanical winch utilizing principles of the invention may include a body formed into any appropriate shape such as, for example, ovoid and the like. A first slot 703(1) is formed on the generally parallel side 716(1) and a second slot 703(2) is formed on the generally parallel side 716(2).

The spool-support assembly 706 slidably engages with the first slot 703(1) and the second slot 703(2). The tether 710, typically constructed of a non-absorbent, non-electrically conductive material, is secured about the spool 708. In a typical embodiment, the tether 710 may comprise, for example, a cable, a wire, a rope, a strap, or the like. The tether passes through an opening 705 formed in the end 718(1). The first connector 712 is coupled to an end of the tether 710 by a first swivel 713 and the second connector 714 is coupled to the end 718(2) by a second swivel 715. A third connector 717 is coupled to the body 702 on the end 718(1). In other embodiments, however, the third connector 717 may be omitted. In a typical embodiment, the first connector 712, the second connector 714, and the third connector 717 may be constructed of, or coated with, a non-electrically-conductive material such as, for example, plastic, Kevlar, fiberglass, or other non-electrically-conductive material. In other embodiments, the first connector 712, the second connector 714, and the third connector 717 may be formed of metallic materials.

Figure 8A:
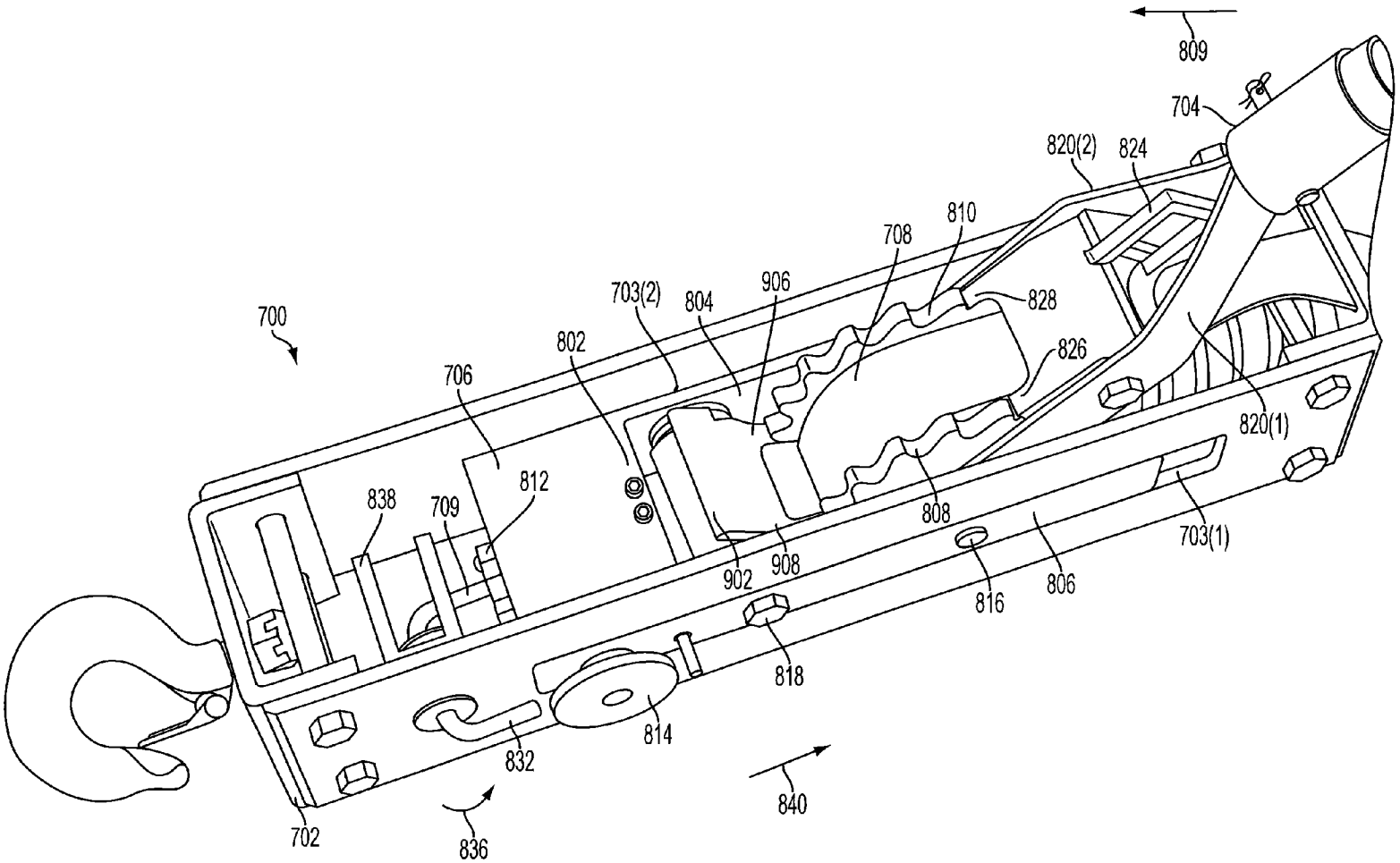
FIG. 8A is a detailed perspective view of the mechanical winch of FIG. 7.

FIG. 8A is a detailed perspective view of the mechanical winch 700. The spool 708 includes a first ratchet wheel 808 and a second ratchet wheel 810 disposed on opposite sides of the spool 708. The spool-support assembly 706 includes a cross member 802, a left-side member 804, and a right-side member 806 oriented generally parallel to the left-side member 804. At least a portion of the left-side member 804 is disposed in the second slot 703(2) and at least a portion of the right-side member 806 is disposed in the first slot 703(1). The cross member 802 is disposed between, and coupled to, the left-side member 804 and the right-side member 806. The cross member 802 maintains a fixed distance between the left-side member 804 and the right-side member 806. An adjustable stop 812 is coupled to the spool-support assembly 706. A knob 814 extends outwardly from the right-side member 806 and facilitates adjustment of the adjustable stop 812. Actuation of the knob 814 extends or retracts the adjustable stop 812. A first axle 816 and a second axle 818 extend through the right-side member 806 and the left-side member 804. The first axle 816 and the second axle 818 are arranged generally parallel to each other between, and generally orthogonal to, the left-side member 804 and the right-side member 806.

The handle 704 includes a pair of opposing arms 820(1)-820(2) and a drive pawl axle 822 disposed between the pair of opposing arms 820(1)-820(2). A drive-pawl assembly 824 is disposed about the drive pawl axle 822. The drive-pawl assembly 824 includes a first drive pawl 826 and a second drive pawl 828. A drive pawl spring (not explicitly shown) is engaged with the drive-pawl assembly 824 and biases the first drive pawl 826 to engage the first ratchet wheel 808 and the second drive pawl 828 to engage the second ratchet wheel 810. The spool 708 and the handle 704 are privotably coupled to the spool-support assembly 706 by the first axle 816. The spool 708 is disposed between the pair of opposing arms 820(1)-820(2) of the handle 704. Interaction of the drive-pawl assembly 824 with the first ratchet wheel 808 and the second ratchet wheel 810 imparts motion to the spool 708 when the handle 704 is actuated in a direction indicated by the arrow 809.

The indicator assembly 709 includes an indicator rod 832 disposed through the body 702. An indicator spring 834 (shown in FIG. 11A) biases the indicator rod 832 to rotate in a direction illustrated by the arrow 836. A chime 838 is coupled to an inner face of the body 702 adjacent to the indicator rod 832.

Figure 8B:
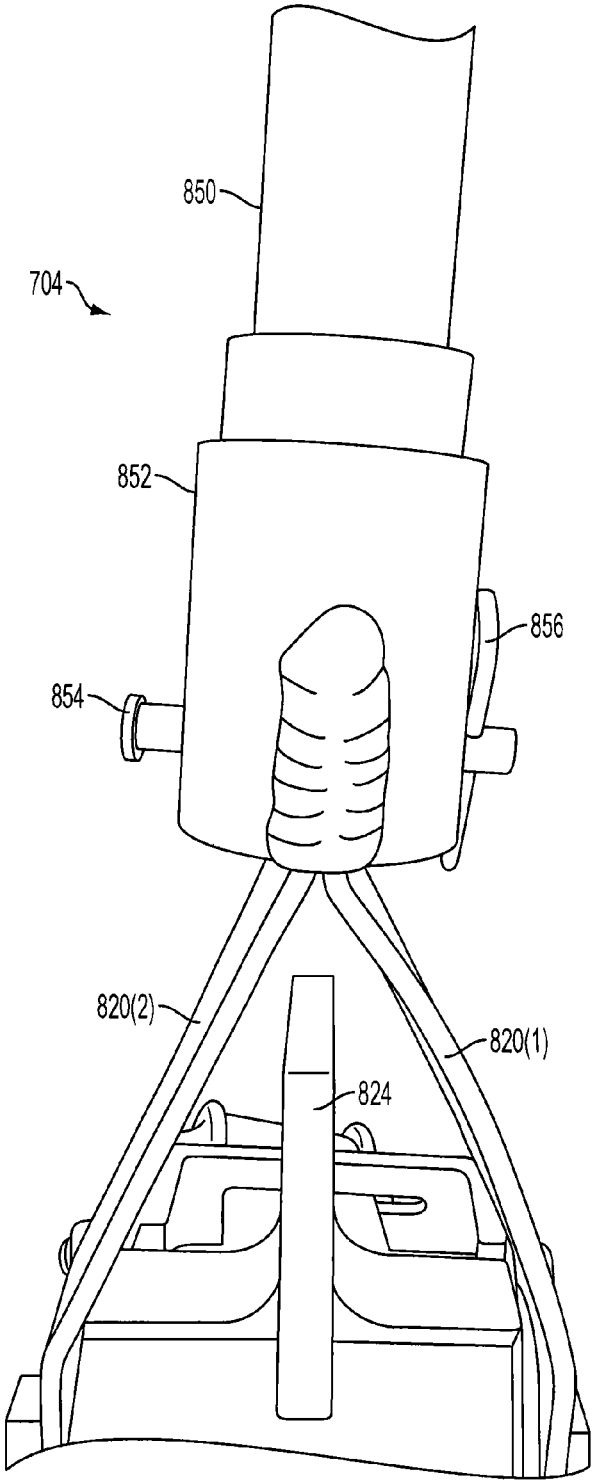
FIG. 8B is a partial front view of a handle of the mechanical winch of FIG. 7.

FIG. 8B is a partial front view of the handle 704. The handle 704 includes a grip portion 850, a sleeve 852, a pin 854, and a clip 856. The grip portion 850 is received into the sleeve 852. The pin 854 passes through the sleeve 852 and the grip portion 850. The clip 856 secures the pin 854 and prevents inadvertent disengagement of the grip portion 850 from the sleeve 852. During storage and transport of the mechanical winch 700 (shown in FIG. 7) it is often desirable to remove the grip portion 850 so that the mechanical winch occupies less storage space. To remove the grip portion 850 from the mechanical winch 700, the clip 856 is first removed from the pin 854. Next, the pin 854 is removed from the sleeve 852 thereby allowing the grip portion 850 to be removed from the sleeve 852. In other embodiments, a mechanical winch utilizing principles of the invention may include a grip portion that is secured with at least one removable bolt.

Figure 9:
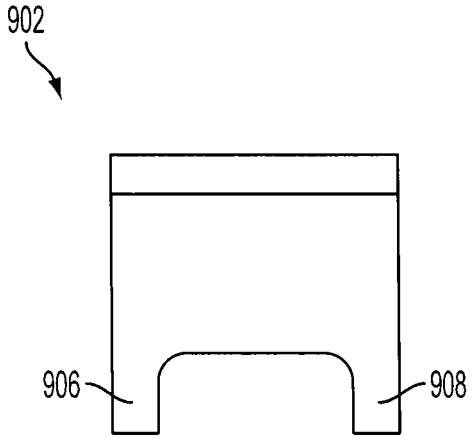
FIG. 9 is a detailed front view of a brake pawl assembly of the mechanical winch of FIG. 7.

FIG. 9 is a front view of an embodiment of a brake-pawl assembly 902. The brake-pawl assembly 902 includes a first brake pawl 906 and a second brake pawl 908. Referring to FIGS. 8A and 9, the brake-pawl assembly 902 and a brake-pawl spring (not shown) are disposed on the second axle 818 between the left-side member 804 and the right-side member 806. The brake-pawl spring (not shown) functions to keep the first brake pawl 906 and the second brake pawl 908 operatively engaged to the first ratchet wheel 808 and the second ratchet wheel 810, respectively, so as to prevent unwinding of the spool 708 when pressure on the handle 704 is released.

Figure 10A:
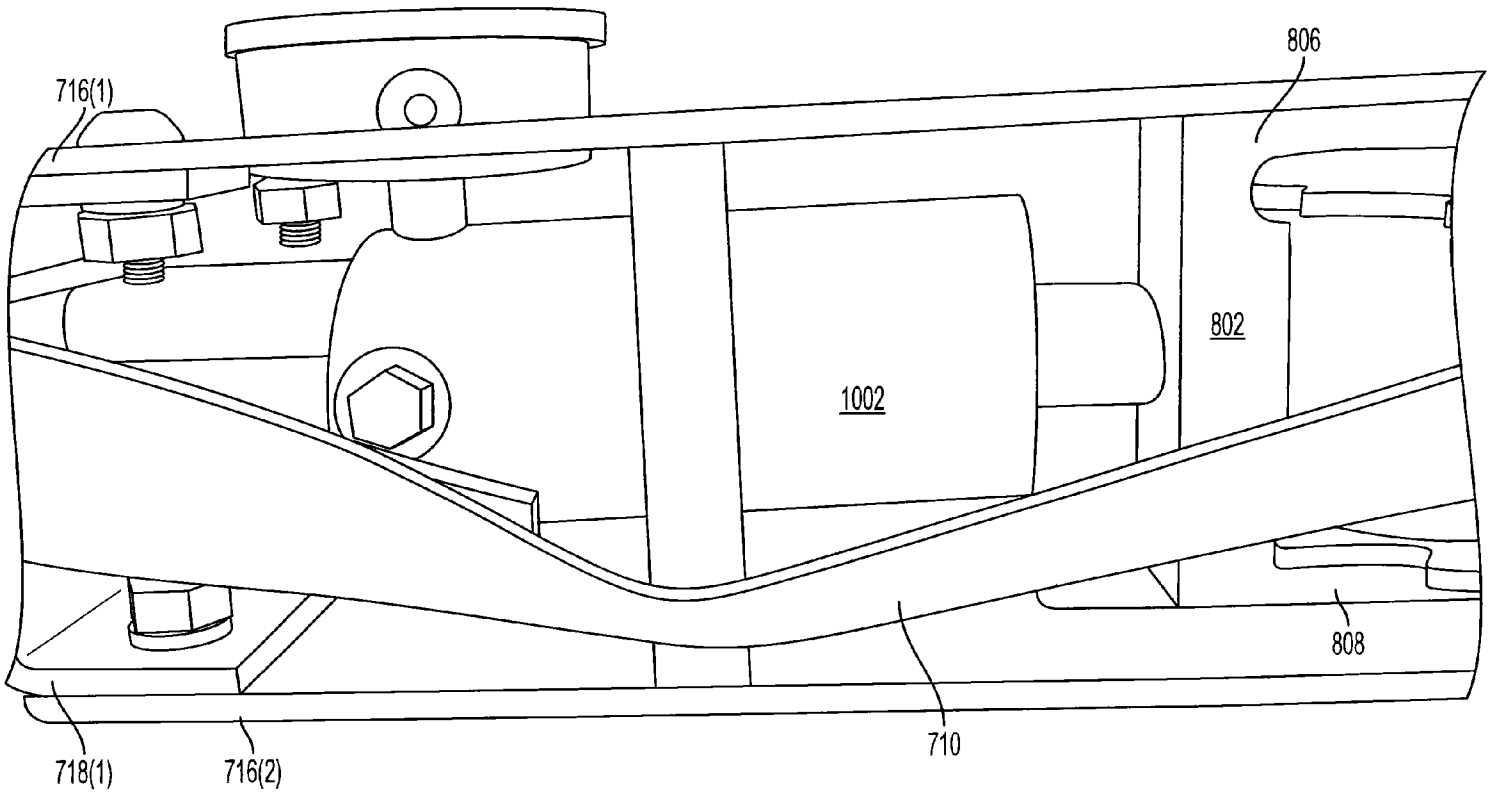
FIGS. 10A-10C are detailed top views of the mechanical winch of FIG. 7 illustrating a spring.
Figure 10B:
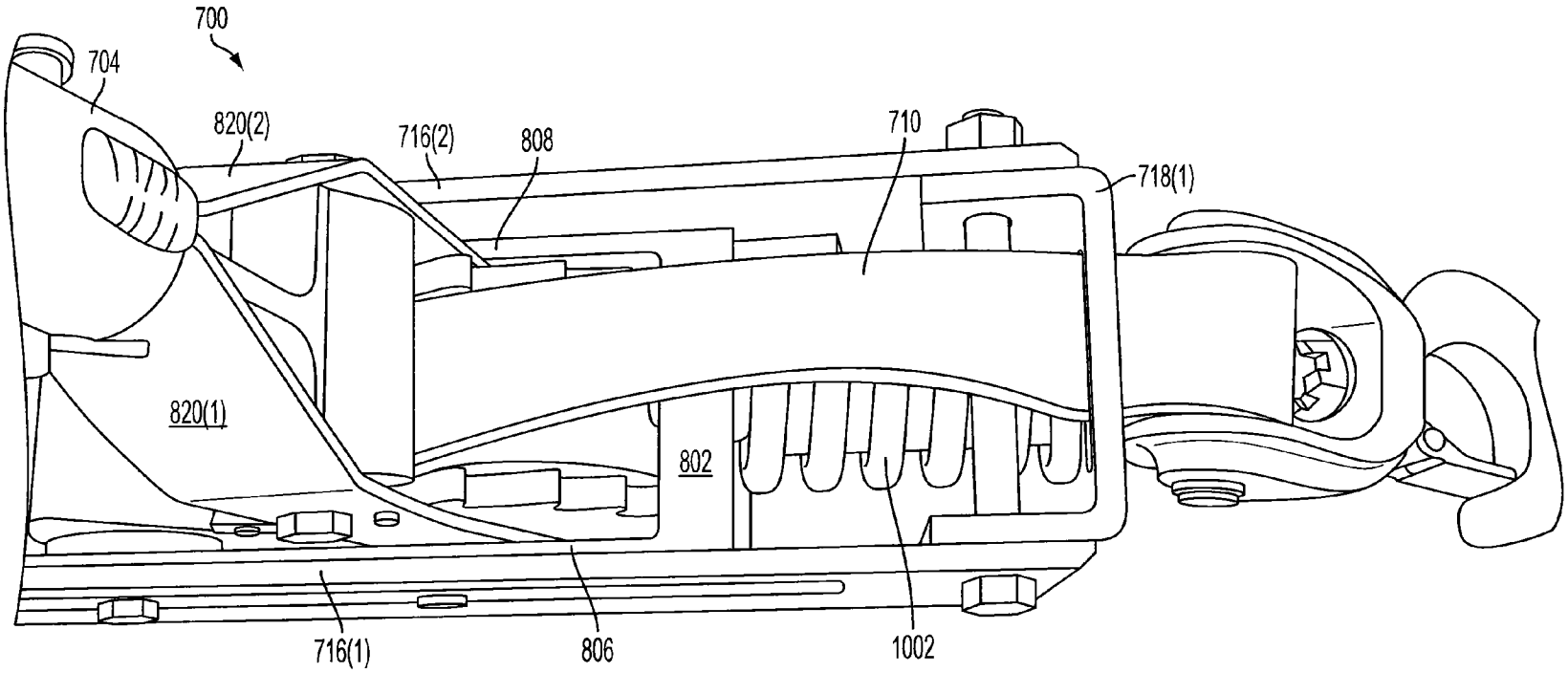
Figure 10C:
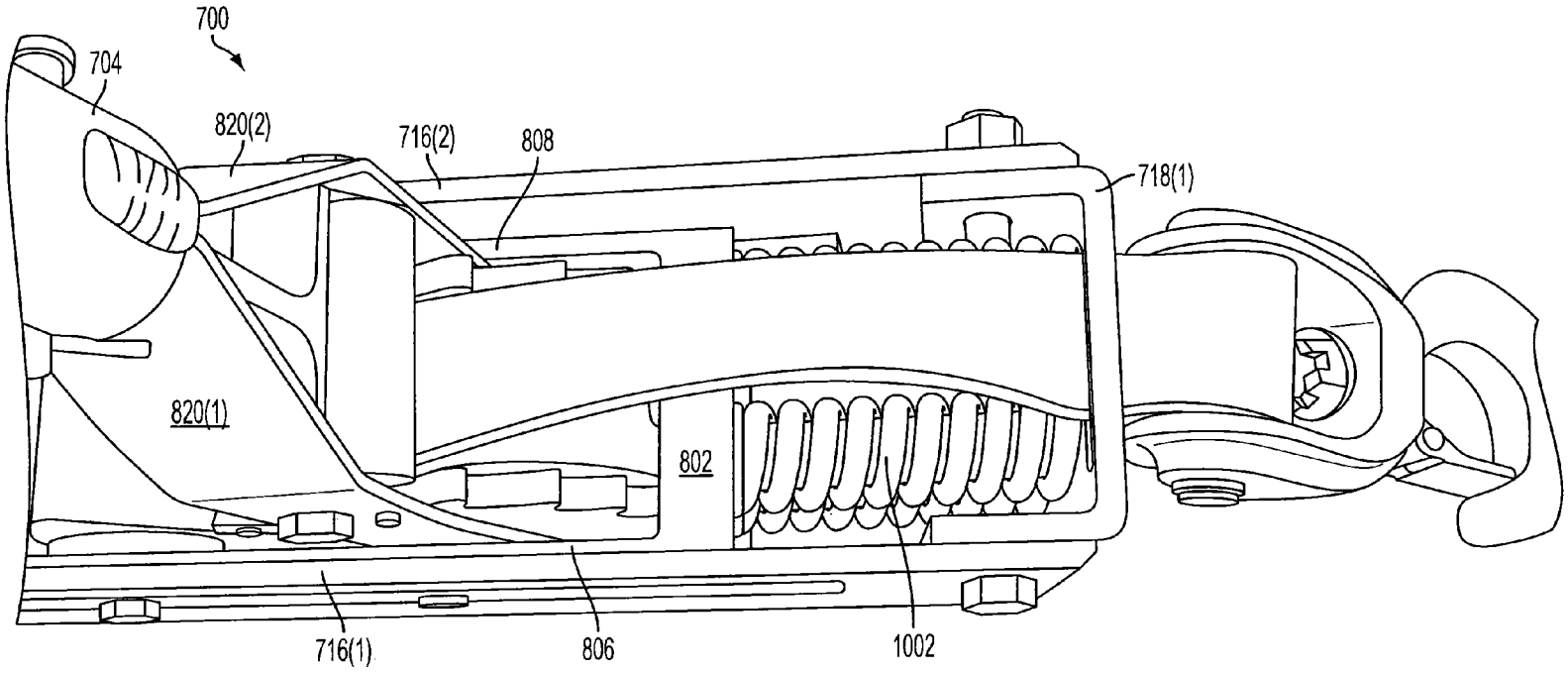

FIGS. 10A-10C are detailed top views of the mechanical winch 700 illustrating the spring 1002. The spring 1002 is disposed between the cross-member 802 and the end 718(1). In a typical embodiment, the spring 1002 biases the spool-support assembly 706 away from the end 718(1). FIG. 10A illustrates an exemplary embodiment where the spring 1002 is a hydraulic cylinder. FIG. 10B illustrates another exemplary embodiment where the spring 1002 is a die spring. In other embodiments, a mechanical winch utilizing principles of the invention may include any number of springs such as, for example, four or more springs. By way of example, FIG. 10C illustrates an embodiment of the mechanical winch 700 having four die springs 1002. In other embodiments, a mechanical winch utilizing principles of the invention may include other types of springs such as, for example a nitrogen-gas spring. In a typical embodiment, the spring 1002 is removable and interchangeable. This functionality allows the mechanical winch 700 to measure a wider range of force, and adapts the mechanical winch 700 for use in a wide array of applications. Interchanging the spring 1002 may be accomplished through any appropriate means. In some embodiments, interchanging the spring 1002 may be accomplished by disengaging the spring 1002 from the spool-support assembly 706 and the body 702.

Figure 11A:
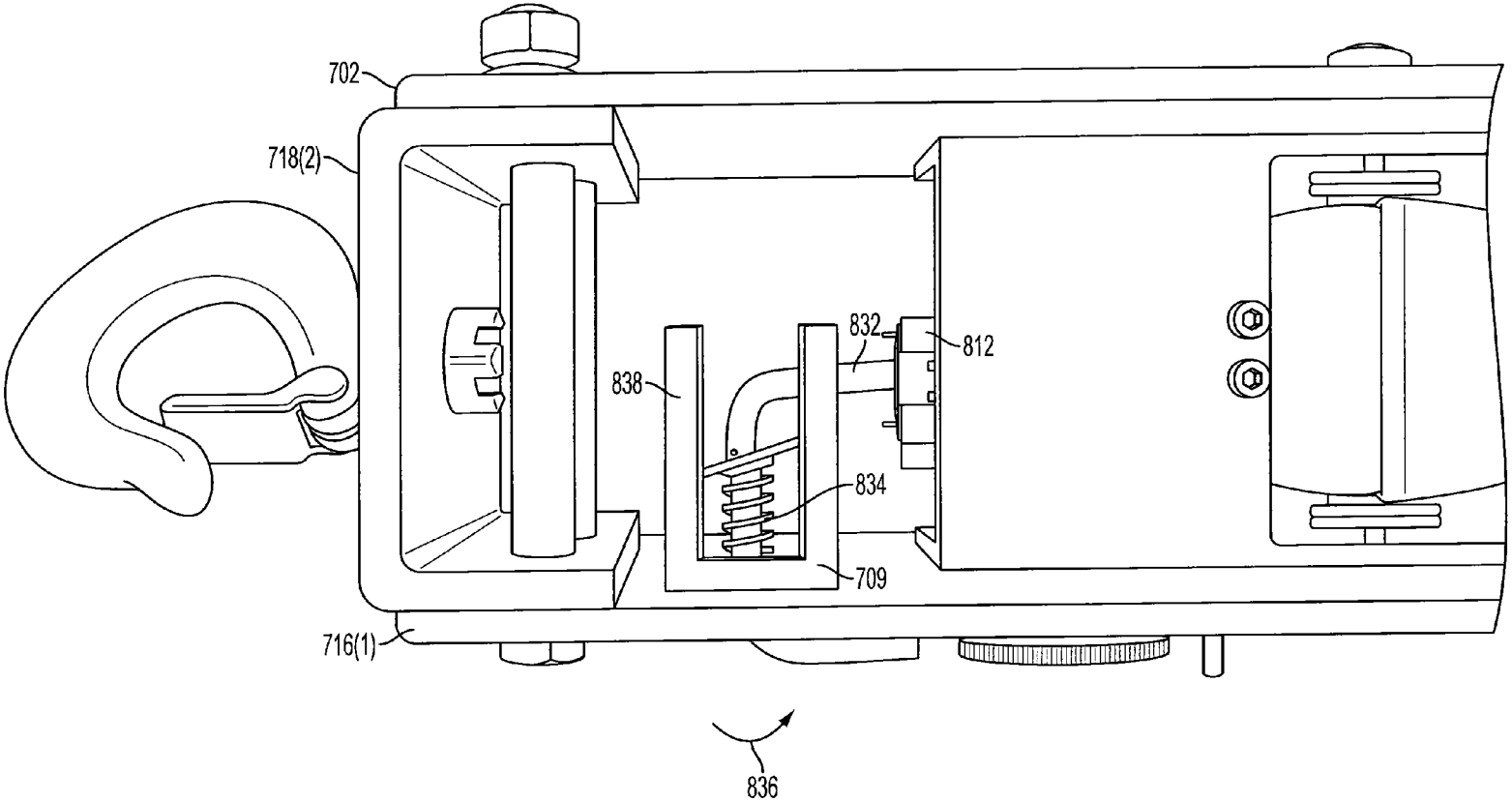
FIG. 11A is a detailed top plan view of the mechanical winch of FIG. 7 illustrating an indicator assembly.

FIG. 11A is a detailed top plan view of the mechanical winch 700 illustrating the indicator assembly 709. As shown in FIG. 11A, the indicator assembly 709 includes the indicator rod 832 disposed through the body 702. The indicator spring 834 biases the indicator rod 832 to rotate in a direction illustrated by the arrow 836. The chime 838 is coupled to an inner face of the body 702 adjacent to the indicator rod 832. During operation, a portion of the indicator rod 832 is engaged with the adjustable stop 812. The adjustable stop 812 prevents rotation of the indicator rod 832 in the direction illustrated by the arrow 836.

Figure 11B:
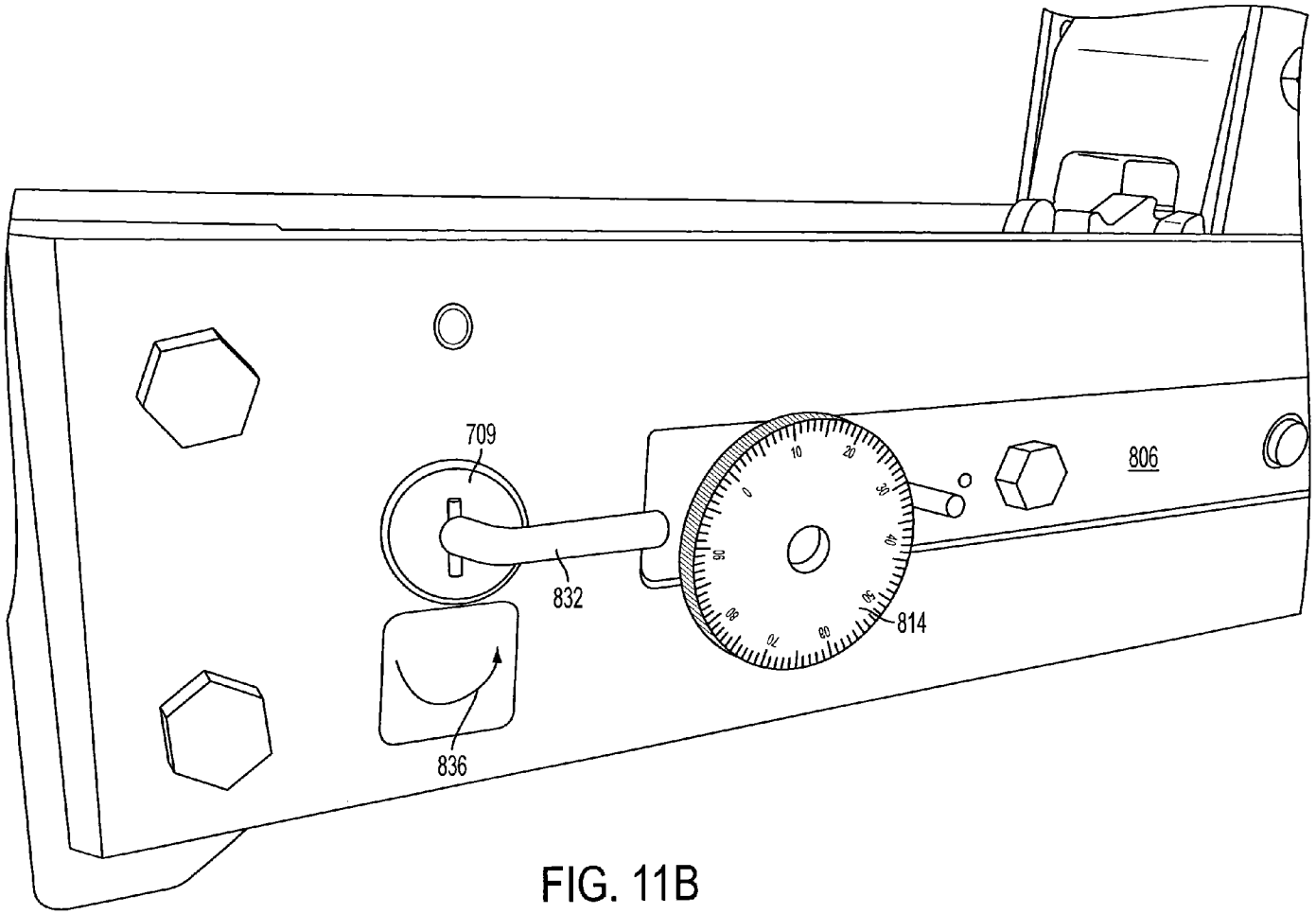
FIG. 11B is a detailed side perspective view of the mechanical winch of FIG. 7 illustrating the indicator assembly.
Figure 11C:
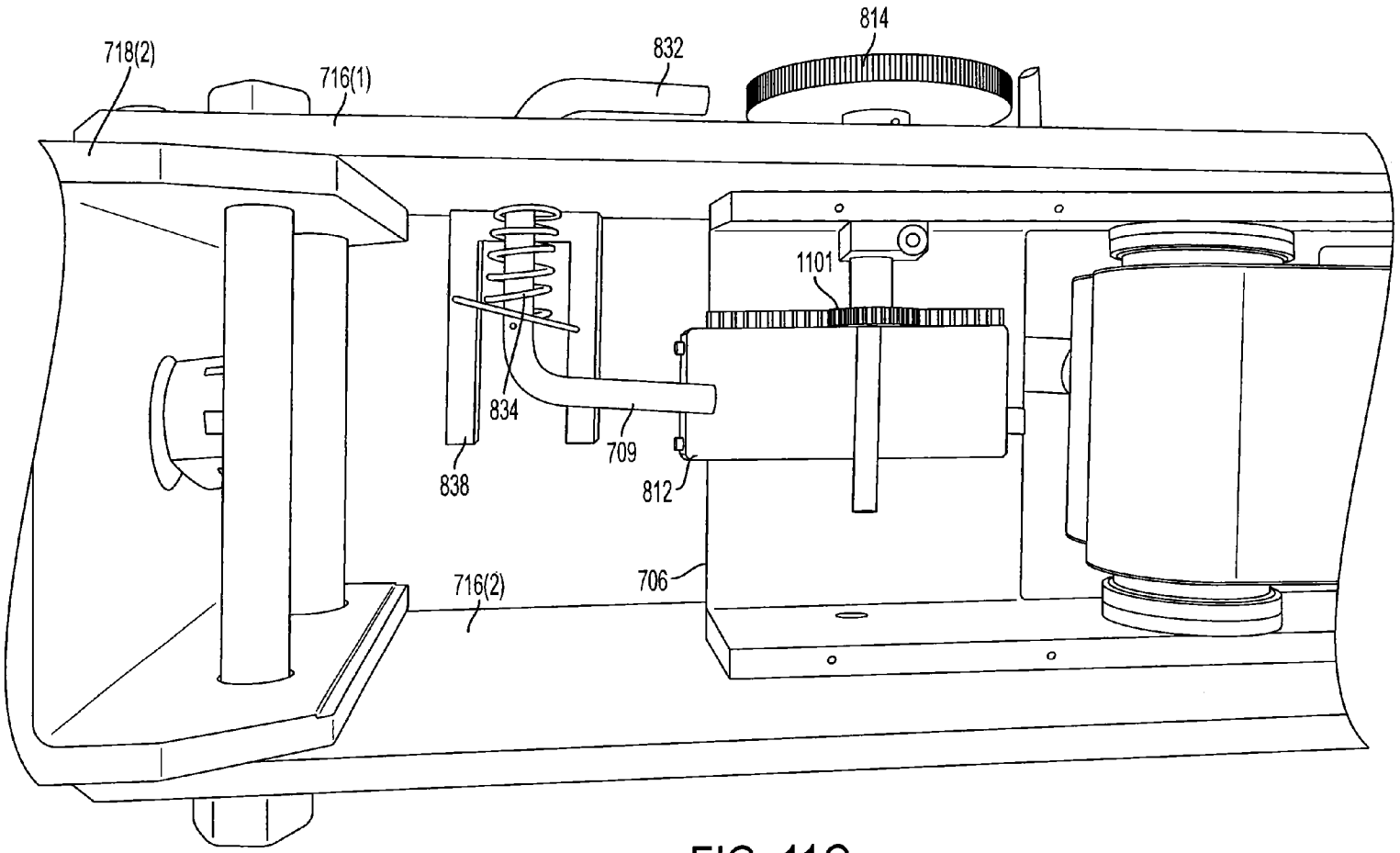
FIG. 11C is a detailed bottom view of the mechanical winch of FIG. 7 illustrating the indicator assembly.

FIG. 11B is a detailed side perspective view of the mechanical winch 700 illustrating the indicator assembly 709. FIG. 11C is a detailed bottom view of the mechanical winch 700 illustrating the indicator assembly 709. As shown in FIG. 11B, the knob 814 extends outwardly from the right-side member 806. The knob 814 has indicia printed thereon that are used to select a desired magnitude of tension to be applied to the tether 710 (shown in FIG. 7). As shown in FIG. 11C, the knob 814 is operatively engaged with the adjustable stop 812 via a gear 1101 such that actuation of the knob 814 extends or retracts the adjustable stop 812 thereby adjusting the desired magnitude of tension to be applied to the tether 710. By way of example, if a large amount of tension is to be applied, the knob 814 is adjusted to expose a greater length of the adjustable stop 812. This results in a larger magnitude of tension being applied to the tether 710 before the indicator rod 832 is released. On the other hand, if a smaller amount of tension is to be applied, the knob 814 is adjusted to expose less of the adjustable stop 812. This results in less tension being applied to the tether 710 before the indicator rod 832 is released.

Referring to FIGS. 11A-11C, in a typical embodiment, setting of the indicator assembly 709 is accomplished by rotating the indicator rod 832 in a direction opposite that defined by the arrow 836. Such rotation causes the indicator spring 834 to bias the indicator rod 832 to rotate in the direction denoted by the arrow 836. In a typical embodiment the indicator rod 832 slides laterally, generally perpendicular to the body 702, so as to allow the indicator rod 832 to be passed underneath the adjustable stop 812. The adjustable stop 812 restrains the tendency of the indicator rod 832 to rotate in the direction denoted by the arrow 836. During operation when the desired magnitude of tension is obtained, the indicator rod 832 becomes disengaged from the adjustable stop 812. The indicator rod 832 then rotates in the direction of the arrow 836 until the indicator rod 832 strikes the chime 838. When the indicator rod 832 strikes the chime 838, an audible tone is emitted. The audible tone signals that the desired magnitude of tension has been reached.

Referring to FIGS. 7-11C, during operation, tension is applied via successive actuation of the handle 704. As a magnitude of the tension increases, the spool-support assembly 706 slides, within the body 702, in a direction denoted by the arrow 840 causing the spring 1002 to compress. As the spool-support assembly 706 slides in the direction denoted by the arrow 840, the adjustable stop 812 also moves in the direction of the arrow 840. When the adjustable stop 812 is moved a sufficient distance to allow the indicator rod 832 to become disengaged, the indicator spring 834 induces the indicator rod 832 to rotate in the direction denoted by the arrow 836. Such motion is accompanied by an audible noise as a portion of the indicator rod 832 strikes the chime 838. The audible noise allows a user to visibly and audibly ascertain when desired magnitude of tension has been reached.

Figure 12A:
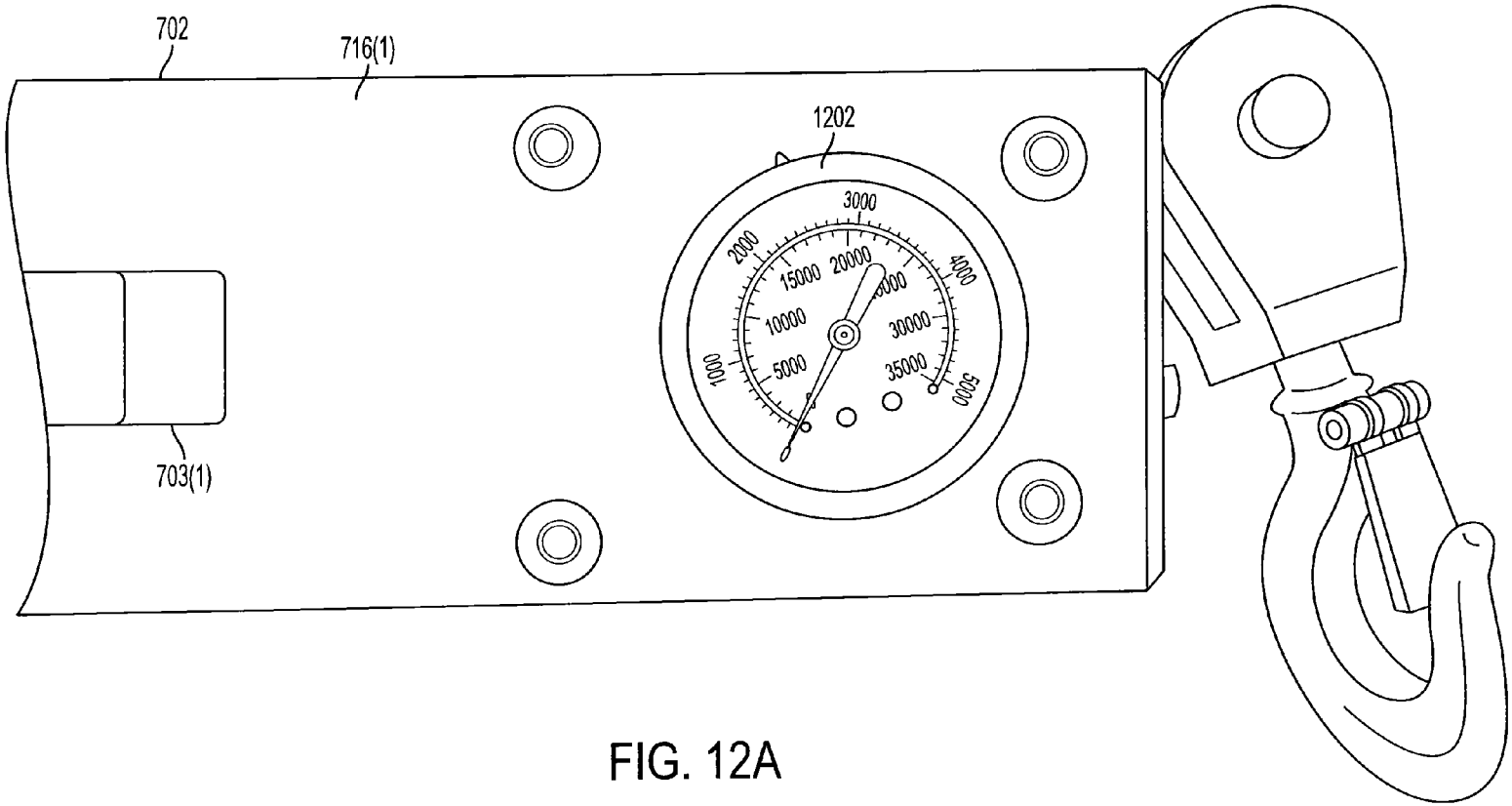
FIGS. 12A-12B are detailed partial perspective views of the mechanical winch of FIG. 7 illustrating a tension gauge.
Figure 12B:
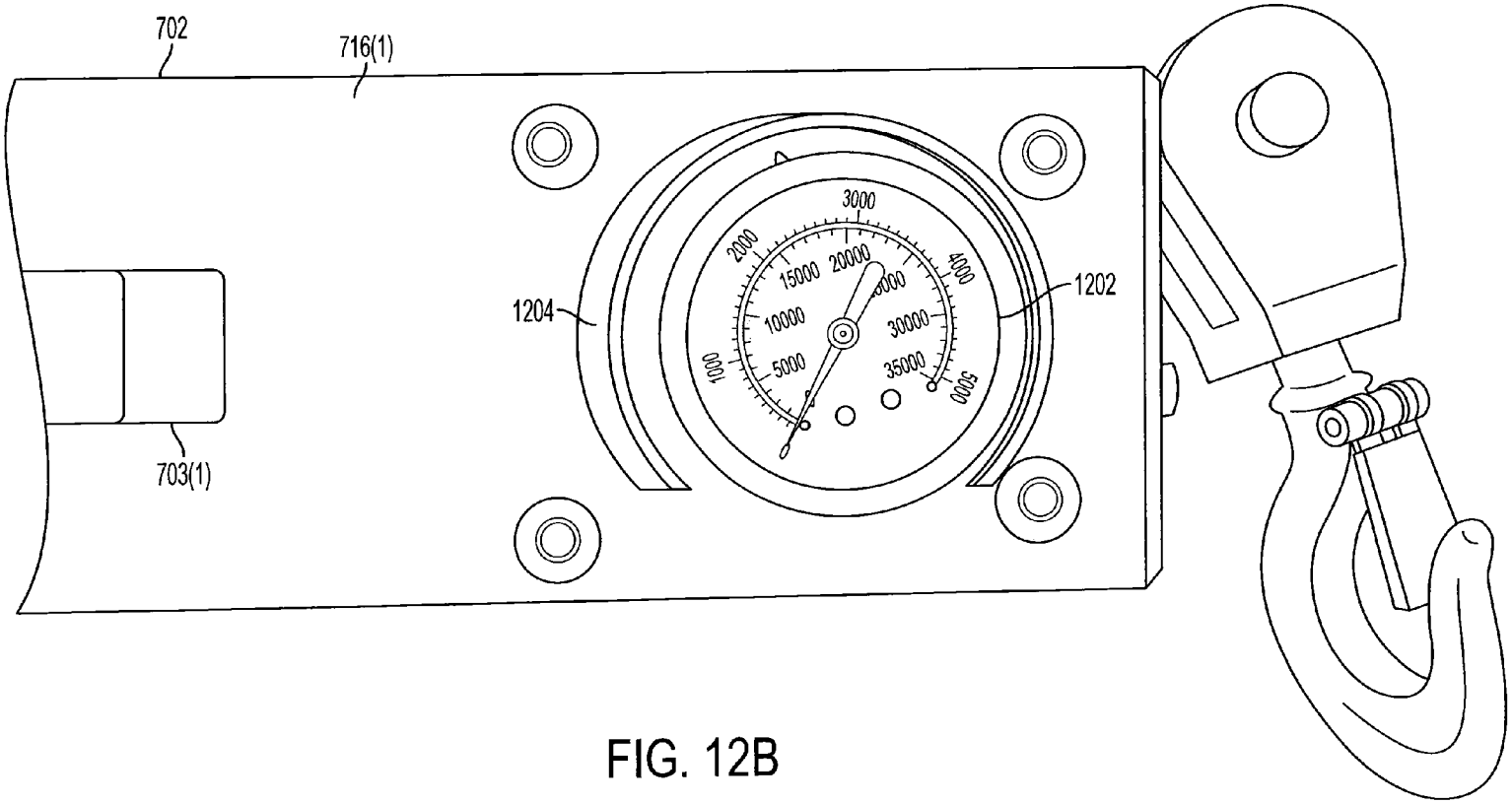

FIG. 12A is a detailed partial perspective view of the mechanical winch 700 illustrating a tension gauge 1202. FIG. 12B is a detailed partial perspective view of the mechanical winch 700 illustrating the tension gauge 1202 and a shield 1204. The tension gauge 1202 may be disposed on the body 702 and interoperably coupled to the spring 1002 such as, for example, hydraulic cylinder shown in FIG. 10A. The tension gauge 1202 is calibrated to measure compression of the spring 1002 and display a magnitude of tension applied to the tether 710. As shown in FIG. 12B, in various embodiments, the shield 1204 may be disposed around the tension gauge 1202. The shield 1204 is a protective barrier and prevents damage to the tension gauge 1202 during operation and storage of a mechanical winch such as, for example, the mechanical winch 700. In other embodiments, a shield utilizing principles of the invention may be embodied in many different forms and is not limited to the shape shown in FIG. 12B. While FIGS. 12A and 12B illustrate the tension gauge 1202, in other embodiments, mechanical winches utilizing principles of the invention may include, for example, a digital load cell or other measuring device to measure compression of the spring 1002 and display a magnitude of tension applied to the tether 710.

Figure 13:
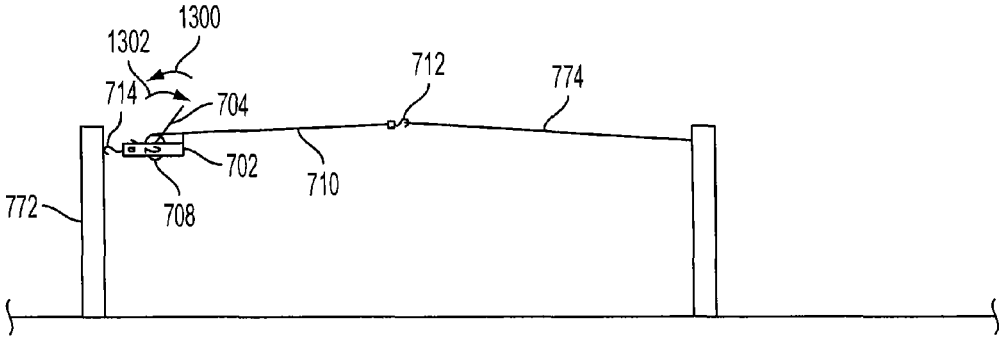
FIG. 13 is a schematic diagram illustrating operation of the mechanical winch of FIG. 7.

FIG. 13 is a schematic diagram illustrating operation of the mechanical winch 700. During operation, the second connector 714 is connected to a support, shown by way of example in FIG. 13 to be a fence post 772. The first connector 712 is attached to a length of cable, wire, or other tensionable element. By way of example, the first connector 712 is shown attached to a length of wire or other tensionable element 774 similar to that used in fencing. In various embodiments, the length of wire or other tensionable element 774 may be electrically-charged such as, for example, an electric transmission wire. In such cases, the non-electrically-conductive body 702 and the non-electrically-conductive tether 710 protect a user from injury. When the handle 704 is actuated in the direction noted by the arrow 1300, the drive-pawl assembly 824 (shown in FIG. 7) engages the first ratchet wheel 808 (shown in FIG. 7) and the second ratchet wheel 810 (shown in FIG. 7), and causes the spool 708 to rotate in the same direction as the handle 704. As the spool 708 rotates, the tether 710 is wound around the spool 708. When the handle 704 is actuated in a direction noted by the arrow 1302, the drive-pawl assembly 824 does not engage, and does not impart any motion to, the first ratchet wheel 808 or the second ratchet wheel 810. In this situation, the brake-pawl assembly 902 (shown in FIG. 8A) engages the first ratchet wheel 808 and the second ratchet wheel 810, and prevents the spool 708 from unwinding and releasing tension on the tether 710. Thus, repeated arcuate movements of the handle 704 results in the tether 710 becoming increasingly wound around the spool 708 and incrementally greater tension being applied to the wire or other tensionable element 774.

Referring collectively to FIGS. 7-13, as a magnitude of tension to the wire or other tensionable element 774 increases, the spool-support assembly 706 tends to slide within the body 702 in a direction denoted by arrow 840. This motion tends to compress the spring 1002. The spool-support assembly 706 maintains a constant distance between the first axle 816 and the second axle 818. Such an arrangement ensures that the brake-pawl assembly 902 remains engaged with the first ratchet wheel 808 and the second ratchet wheel 810 thus preventing an inadvertent release of tension. A magnitude of tension applied to the wire or other tensionable element 774 can be measured using, for example, the tension gauge 1202. In various alternative embodiments, linear deflection of the spring 1002 is measured utilizing a scale (not shown) attached to the body 702. The magnitude of force applied can then be determined through the application of Hooke's Law ($F=-kx$), where F is the force applied, x is the linear deflection of the spring 1002 away from its equilibrium position, and k is a physical property of the spring 1002 known as the "force constant" or "spring constant." This property is commonly referred to as the "stiffness" of the spring 1002.

In the event that the operator desires to relieve tension applied to the wire or other tensionable element 774, the operator fully actuates the handle 704 in the direction depicted by the arrow 1300. If a large magnitude of tension has been applied to the wire or other tensionable element 774, it may be necessary to actuate the drive-pawl assembly 824 so as to disengage the drive-pawl assembly 824 from the first ratchet wheel 808 and the second ratchet wheel 810. Such disengagement allows the handle 704 to rotate independently of the spool 708 without applying any additional tension to the wire or other tensionable element 774. When the handle 704 has been fully actuated in the direction depicted by the arrow 1300, the drive-pawl assembly 824 contacts the brake-pawl assembly 902. The interaction between the drive-pawl assembly 824 and the brake-pawl assembly 902 causes the brake-pawl assembly 902 to also become disengaged from the first ratchet wheel 808 and the second ratchet wheel 810. Disengagement of both the drive-pawl assembly 824 and the brake-pawl assembly 902 allows the spool 708 to rotate freely to relieve tension applied to the wire or other tensionable element 774.

Figure 14:
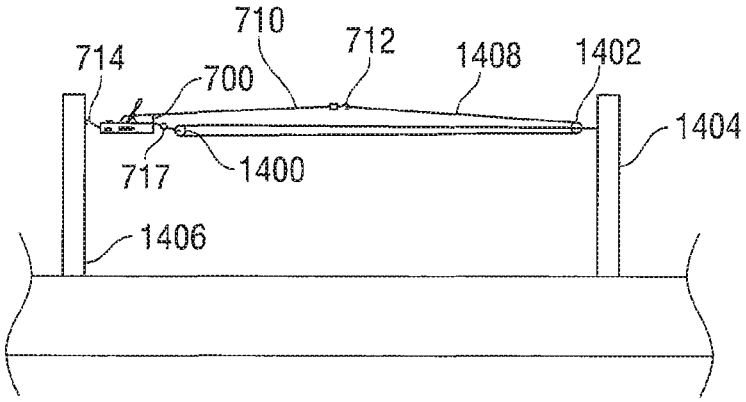
FIG. 14 is a schematic diagram is a schematic diagram illustrating operation of the mechanical winch of FIG. 7.

FIG. 14 is a schematic diagram illustrating operation of the mechanical winch 700. In various applications, it is desirable to utilize the mechanical winch 700 in conjunction with a block-and-tackle pulley system. In such an arrangement, a first pulley 1400 is connected to the third connector 717. A second pulley 1402 is connected to an object such as, for example, a fence post 1404. The second connector 714 is attached to a support such as, for example, a fence post 1406. The first connector 712 is attached to a wire, a cable or other tensionable element 1408. The cable or other tensionable element 1408 is wound around the first pulley 1400 and the second pulley 1402. In various alternative embodiments, the tether 710 may be wound around the first pulley 1400 and the second pulley 1402.

Figure 15A:
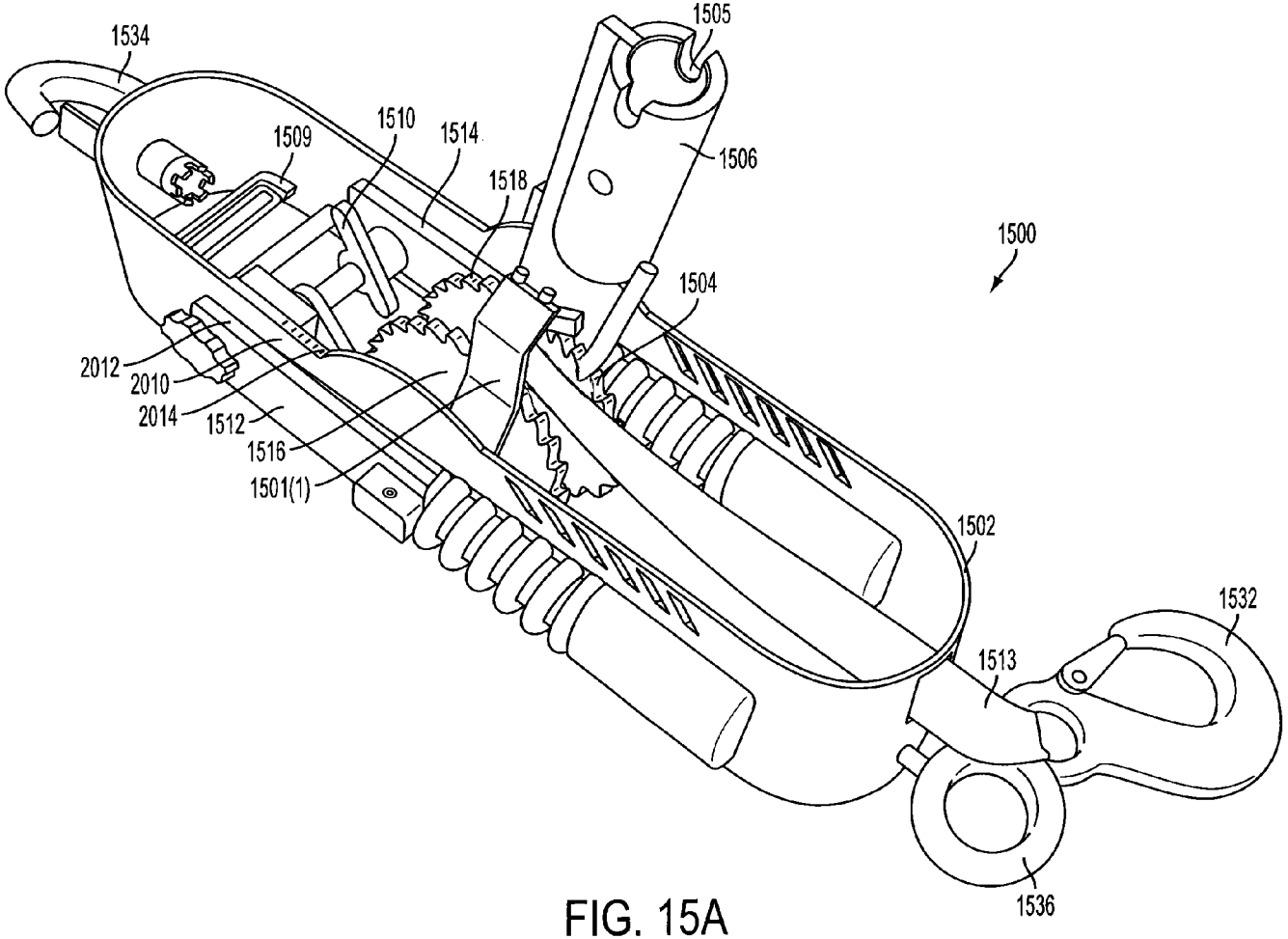
FIG. 15A is a perspective view of a third embodiment of a mechanical winch.
Figure 15B:
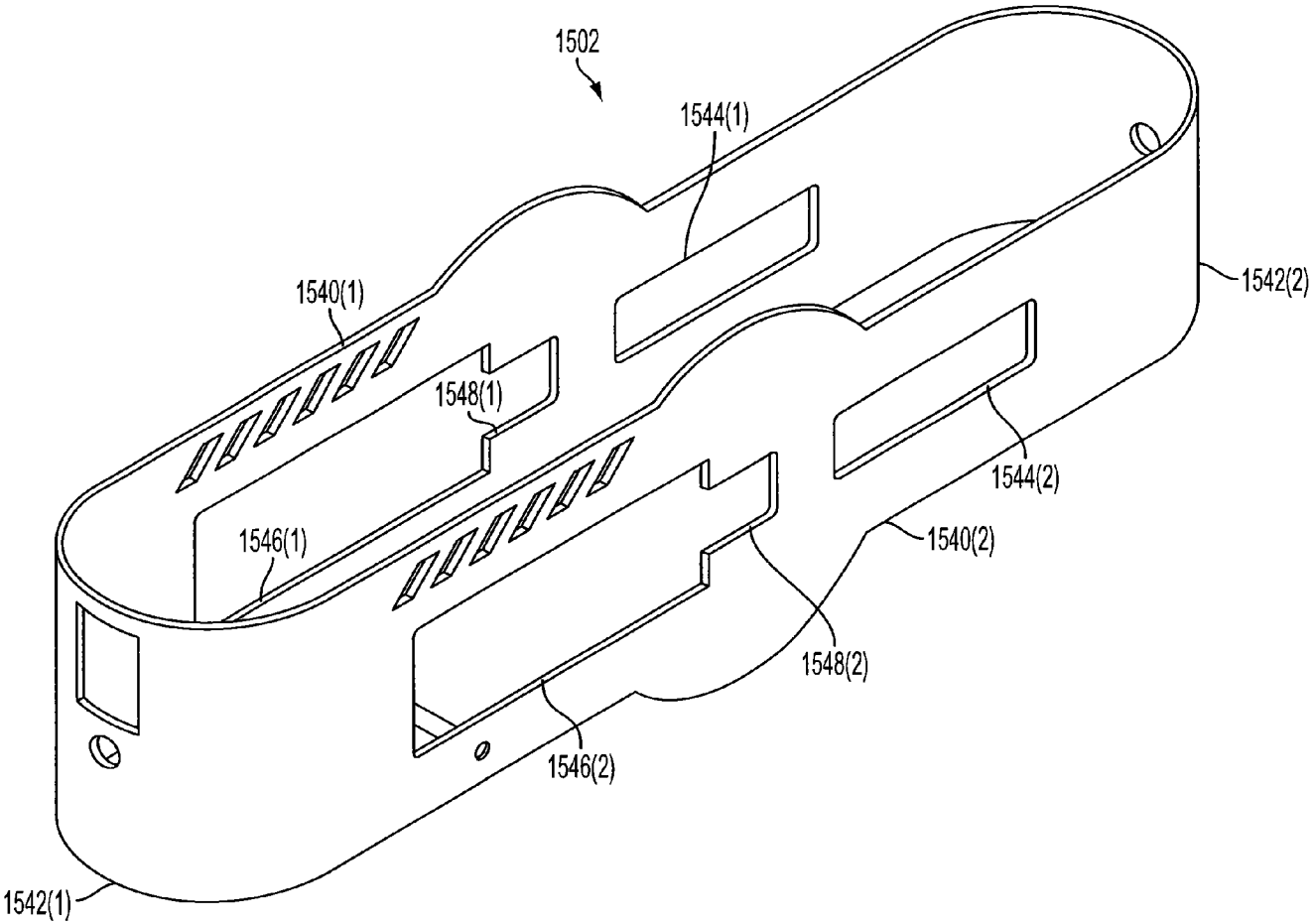
FIG. 15B is a perspective view of a body of the mechanical winch of FIG. 15A.

FIG. 15A is a perspective view of a third embodiment of a mechanical winch 1500. The mechanical winch 1500 includes a body 1502, a spool 1504 rotatably disposed in the body 1502, a handle 1506 pivotably coupled to the body 1502, a spool axle (not explicitly shown), a brake-pawl assembly 1510 disposed within the body 1502, an indicator assembly 1509 disposed within the body 1502, a right sliding assembly 1512 coupled to the body 1502, and a left sliding assembly 1514 coupled to the body 1502. FIG. 15B is a perspective view of the body 1502. The body 1502 may be constructed of any appropriate material such as, for example, a non-electrically-conductive material thereby allowing the mechanical winch 1500 (shown in FIG. 15A) to be used in applications involving tensioning of electrically-charged objects such as, for example, electrical transmission wires and the like. The body 1502 is formed into a roughly ovoid shape having parallel sides 1540(1)-(2) and ends 1542(1)-(2). The body 1502 is formed of a unitary piece of material. In other embodiments, mechanical winches utilizing principles of the invention may include a body that is formed by joining parallel sides to ends through a process such as, for example, welding. Although, the body 1502 is depicted by way of example as being roughly ovoid, the body 1502 may be formed into any other appropriate shape as required, such as, for example, rectangular and the like. A slot 1544(1) and 1544(2), having the form of a rectangular slot, is disposed on the parallel sides 1540(1) and 1540(2), respectively. Similarly, a slot 1546(1)-(2), also having the form of a rectangular slot of slightly greater length and width than the slot 1544(1)-(2), is also disposed on the parallel sides 1540(1)-(2), respectively. A notch 1548(1) is formed in the slot 1546(1) on a side facing the slot 1544(1) and a notch 1548(2) is formed in the slot 1546(2) on a side facing the slot 1544(2).

Referring again to FIG. 15A, the spool 1504 includes a first ratchet wheel 1516 and a second ratchet wheel 1518 disposed on opposite sides thereof. The spool 1504 is secured between opposing sides 1520(1)-(2) of the handle 1506. In a typical embodiment, the spool 1504 is rotatably secured thereto by the spool axle (not explicitly shown); however, in other embodiments, the spool 1504 may be secured to the handle 1506 in any appropriate arrangement as dictated by design requirements. The spool axle secures the spool 1504 and the handle 1506 to the right sliding assembly 1512 and the left sliding assembly 1514. A tether 1513 is secured to the spool 1504 and wrapped therearound. In a typical embodiment, the tether 1513 is constructed of a non-absorbent, non-conductive material such as, for example, Kevlar. A first connector 1532 is secured to the tether 1513. A second connector 1534 is secured to the end 1542(2). A third connector 1536 is secured to the end 1542(1). During operation, the tether 1513 may be utilized to tension an electrically-charged object such as, for example, an electrical transmission wire.

Figure 16:
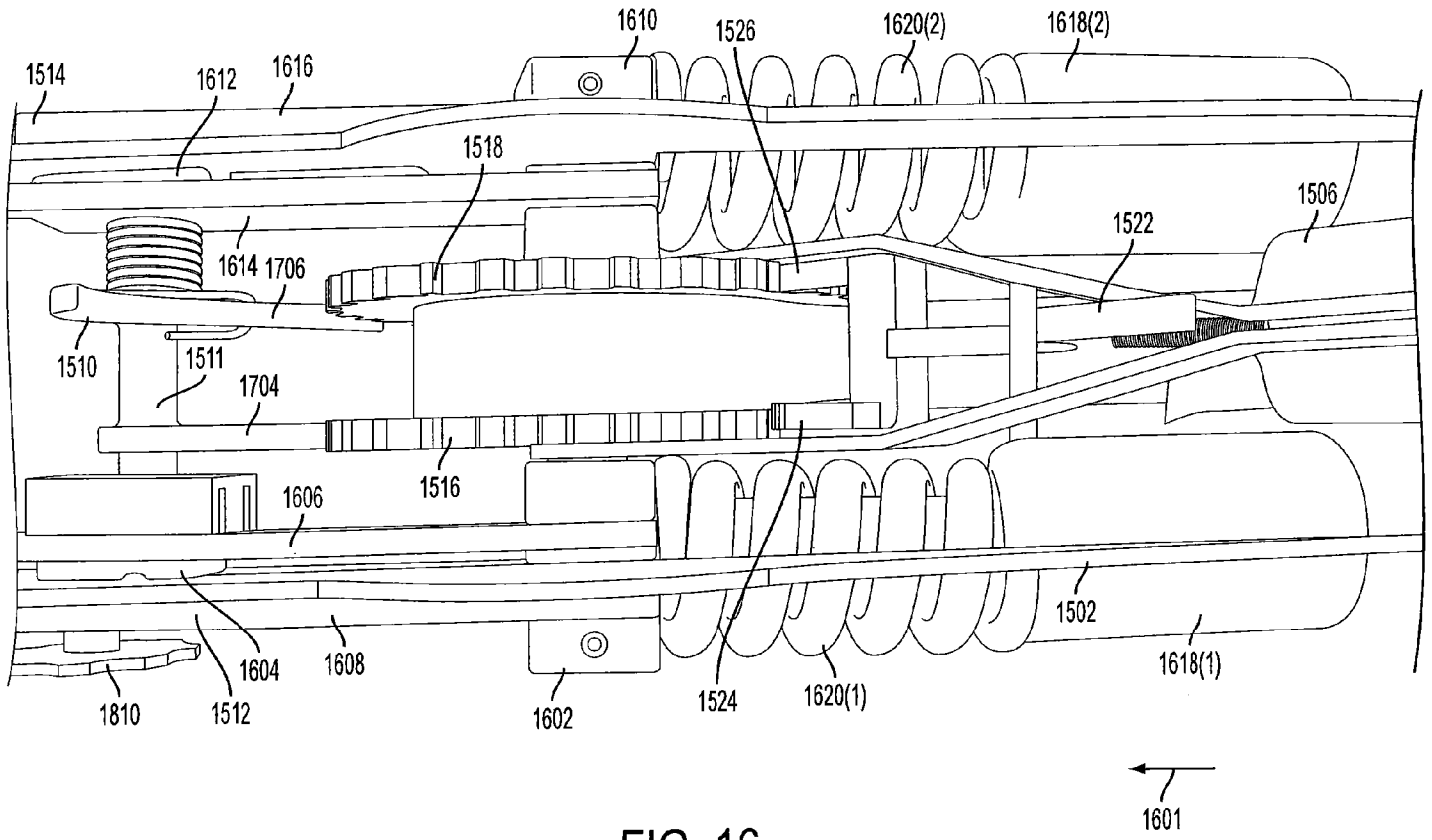
FIG. 16 is a detailed partial top plan view of a central aspect of the mechanical winch of FIG. 15A.

FIG. 16 is a detailed partial top plan view illustrating a central aspect of the mechanical winch 1500. The right sliding assembly 1512 and the left sliding assembly 1514 secure the spool 1504 and the brake-pawl assembly 1510 within the body 1502. The right sliding assembly 1512 includes a front cross-member 1602, a rear cross-member 1604, an inner brace 1606, and an outer brace 1608. The left sliding assembly includes a front cross-member 1610, a rear cross-member 1612, an inner brace 1614, and an outer brace 1616. The front cross-member 1602 is slidably disposed within the notch 1548(1) (shown in FIG. 15B) and the front cross-member 1610 is slidably disposed within the notch 1548(2) (shown in FIG. 15B). The rear cross-member 1604 is slidably disposed within the slot 1544(1) (shown in FIG. 15B) and the rear cross-member 1612 is slidably disposed within the slot 1544(2) (shown in FIG. 15B). The inner brace 1606 is disposed on an interior aspect of the body 1502 and connects the front cross-member 1602 with the rear cross-member 1604. The inner brace 1614 is disposed on an interior aspect of the body 1502 and connects the front cross-member 1610 with the rear cross-member 1612. The outer brace 1608 is disposed on an exterior aspect of the body 1502 and connects the front cross-member 1602 with the rear cross-member 1604. The outer brace 1616 is disposed on an exterior aspect of the body 1502 and connects the front cross-member 1610 with the rear cross-member 1612. A spring cup assembly 1618(1) is disposed within the slot 1546(1) (shown in FIG. 15B) and a spring cup assembly 1618(2) is disposed within the slot 1546(2) (shown in FIG. 15B). A spring 1620(1) is disposed in the slot 1546(1) so as to abut the spring cup assembly 1618(1) and the right sliding assembly 1512. Similarly, a spring 1620(2) is disposed in the slot 1546(2) so as to abut the spring cup assembly 1618(2) and the left sliding assembly 1514. In a typical embodiment, the spring 1620(1)-(2) is a die spring; however, in various alternative embodiments other types of springs such as, for example, a nitrogen-gas spring may also be utilized. In a typical embodiment, a nitrogen gas spring can support tensions in excess of 2,000 pounds.

Figure 17:
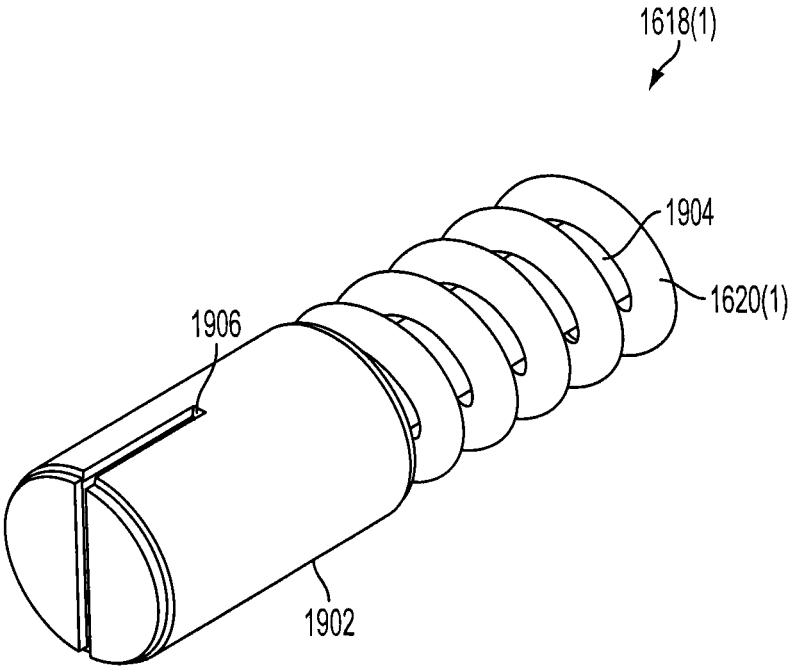
FIG. 17 is a detailed perspective view of a spring cup of the mechanical winch of FIG. 15A.

FIG. 17 is a detailed perspective view of the spring cup assembly 1618(1). The spring cup assembly 1618(1) includes a spring-cup body 1902 and a guide post 1904. The spring 1620(1) is disposed about the guide post 1904 so as to abut the spring-cup body 1902. A slot 1906 is disposed in the spring-cup body 1902. The slot 1906 receives a portion of the body 1502 defining a border of the slot 1546(1) (shown in FIG. 15B). The spring cup assembly 1618(2) is similar in terms of construction and operation to the spring cup assembly 1618(1).

Referring again to FIG. 16, the handle 1506 includes a drive-pawl assembly 1522. The drive-pawl assembly 1522 includes a first drive pawl 1524 and a second drive pawl 1526. The first drive pawl 1524 is disposed to engage the first ratchet wheel 1516 and the second drive pawl 1526 is disposed to engage the second ratchet wheel 1518. Interaction of the first drive pawl 1524 and the second drive pawl 1526 with the first ratchet wheel 1516 and the second ratchet wheel 1518 imparts motion to the spool 1504 when the handle 1506 is rotated in a direction denoted by arrow 1601. The handle 1506 includes a sleeve 1505 (shown in FIG. 15A) adapted for receiving a grip (not shown).

The brake-pawl axle 1511 is disposed between the right sliding assembly 1512 and the left sliding assembly 1514 at a position proximal to the spool axle (not explicitly shown). The brake-pawl axle 1511 passes through, and is secured to, the rear cross-member 1604 and the rear cross-member 1612. The brake-pawl assembly 1510 and a brake-pawl spring 1702 are disposed on the brake-pawl axle 1511 between the right sliding assembly 1512 and the left sliding assembly 1514. The brake-pawl assembly 1510 includes a first brake pawl 1704 and a second brake pawl 1706. The brake-pawl spring 1702 functions to keep the first brake pawl 1704 and the second brake pawl 1706 operatively engaged to the first ratchet wheel 1516 and the second ratchet wheel 1518, respectively, so as to prevent unwinding of the spool 1504 when pressure on the handle 1506 is released.

Figure 18:
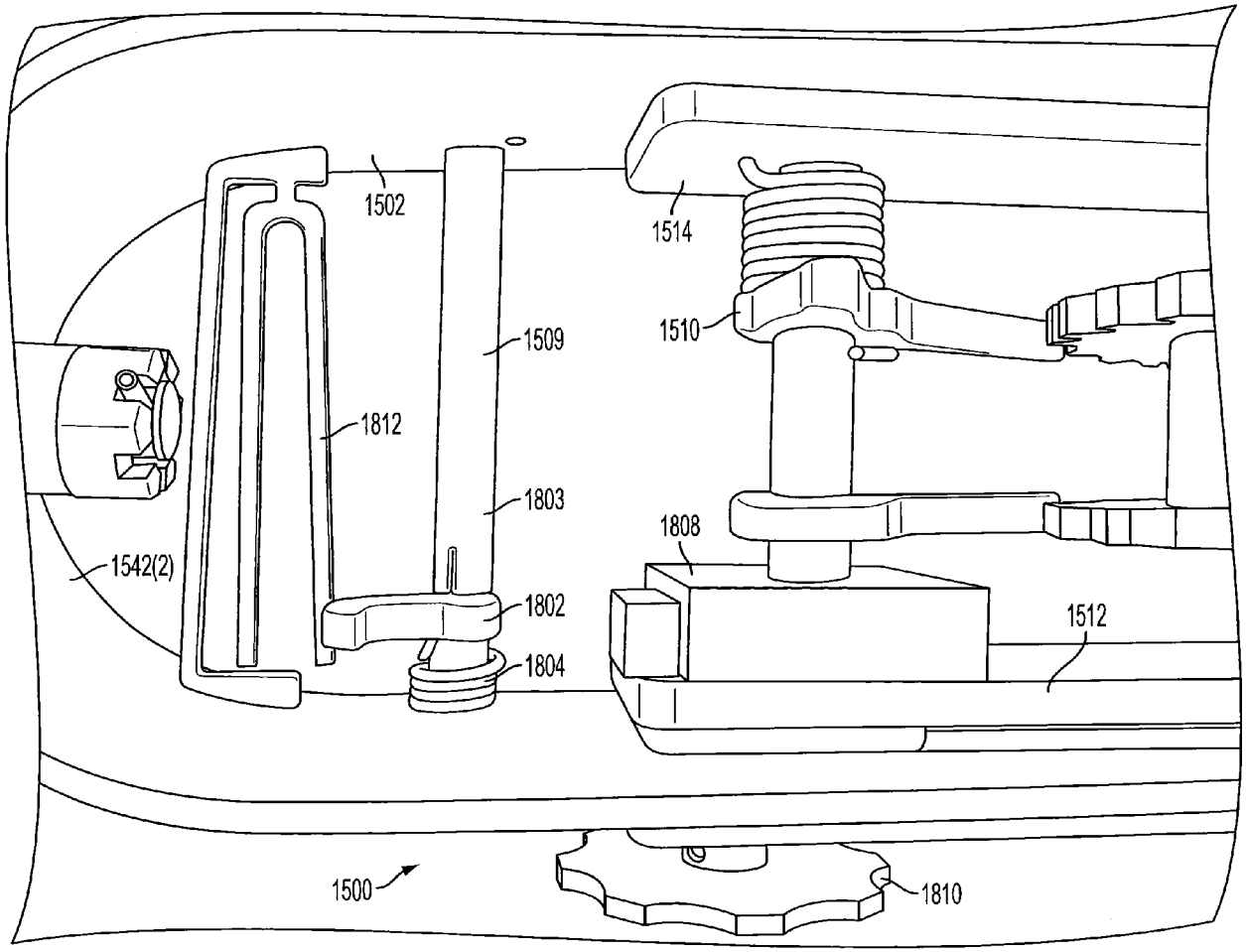
FIG. 18 is a detailed partial top plan view of the mechanical winch of FIG. 15A illustrating an indicator assembly.

FIG. 18 is a detailed partial top plan view of the mechanical winch 1500 illustrating an indicator assembly 1509. The indicator assembly 1509 includes a hammer 1802 is disposed on an indicator axle 1803. An indicator spring 1804 biases the hammer 1802 to rotate in a direction of arrow 1806. An adjustable stop 1808 is connected to the left sliding assembly 1514. The adjustable stop 1808 functions to prevent rotation of the hammer 1802. A knob 1810 facilitates adjustment of the adjustable stop 1808. Actuation of the knob 1810 extends or retracts the adjustable stop 1808 thereby adjusting the amount of force required to release the hammer 1802. A chime 1812 is disposed within the body 1502 proximate to the indicator axle 1803. In a typical embodiment, during operation, when the desired level of tension is obtained, the hammer 1802 becomes disengaged from the adjustable stop 1808. The hammer 1802 then rotates in the direction of the arrow 1806 until the hammer 1802 strikes the chime 1812. When the hammer 1802 strikes the chime 1812, an audible tone is emitted. The audible tone signals that the desired level of tension has been reached.

Prior to use of the mechanical winch 1500 (shown in FIG. 15A), the adjustable stop 1808 must be adjusted for an amount of tension to be applied. This is accomplished by adjusting the knob 1810 to change an exposed length of the adjustable stop 1808. By way of example, if a large amount of tension is to be applied, the knob 1810 is adjusted to expose a greater length of the adjustable stop 1808. This results in more tension being applied before the hammer 1802 is released. On the other hand, if a smaller amount of tension is to be applied, the knob 1810 is adjusted to expose less of the adjustable stop 1808. This results in less tension being applied before the hammer 1802 is released.

Setting the hammer 1802 is accomplished by rotating the hammer 1802 about the indicator axle 1803 in a direction opposite that defined by the arrow 1806. Such rotation causes the indicator spring 1804 to bias the hammer 1802 to rotate in the direction denoted by the arrow 1806. During setting, the hammer 1802 may slide laterally across the indicator axle 1803 so as to allow the hammer 1802 to be passed underneath the adjustable stop 1808. The adjustable stop 1808 restrains the tendency of the hammer 1802 to rotate in the direction denoted by the arrow 1806.

Referring now to FIGS. 15A-18, during operation, tension is applied through successive actuation of the handle 1506. As a magnitude of tension increases, the left sliding assembly 1514, the right sliding assembly 1512, the adjustable stop 1808, and the spool 1504 tend to slide, within the body 1502, in a direction denoted by the arrow 1528 causing the spring 1620 (1)-(2) to compress. Sufficient tension is applied to move the adjustable stop 1808 a sufficient distance to allow the adjustable stop 1808 to become disengaged from the hammer 1802. The indicator spring 1804 induces the hammer 1802 to rotate about the indicator axle 1803 in the direction denoted by the arrow 1806. In some embodiments, such motion is accompanied by an audible noise as a portion of the hammer 1802 strikes the chime 1812. This arrangement allows a user to visibly and audibly ascertain when a pre-determined magnitude of tension has been applied.

Figure 19:
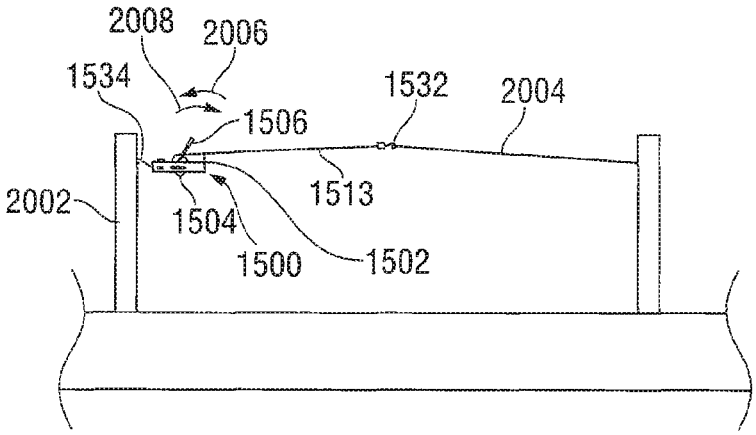
FIG. 19 is a schematic diagram illustrating operation of the mechanical winch of FIG. 15A.

FIG. 19 is a schematic diagram illustrating operation of the mechanical winch 1500. During operation, the second connector 1534 is connected to a support, shown by way of example in FIG. 19 to be a fence post 2002. The first connector 1532 is attached to a length of cable, wire, or other tensionable element. By way of example, the first connector 1532 is shown attached to a length of wire 2004 similar to that used in fencing. In various embodiments, the length of wire 2004 may be electrically-charged such as, for example, an electric transmission wire. In such cases, the electrically non-conductive body 1502 and the electrically non-conductive tether 1513 protect a user from injury. When the handle 1506 is actuated in the direction noted by arrow 2006, the drive-pawl assembly 1522 (shown in FIG. 16) engages the first ratchet wheel 1516 (shown in FIG. 16) and the second ratchet wheel 1518 (shown in FIG. 16), and causes the spool 1504 to rotate in the same direction as the handle 1506. As the spool 1504 rotates, the tether 1513 is wound around the spool 1504. When the handle 1506 is actuated in a direction noted by arrow 2008, the drive-pawl assembly 1522 does not engage, and does not impart any motion to, the first ratchet wheel 1516 or the second ratchet wheel 1518. In this situation, the brake-pawl assembly 1510 (shown in FIG. 16) engages the first ratchet wheel 1516 and the second ratchet wheel 1518, and prevents the spool 1504 from unwinding and releasing tension on the tether 1513. Thus, repeated arcuate movements of the handle 1506 results in the tether 1513 becoming increasingly wound around the spool 1504 and incrementally greater tension being applied to the wire 2004.

Referring now to FIGS. 15A-19, as the magnitude of tension applied to the wire 2004 increases, the spool 1504 tends to slide within the body 1502 in a direction denoted by the arrow 1530. This motion tends to compress the spring 1620(1)-(2). As the spool 1504 slides in the direction denoted by the arrow 1530, the right sliding assembly 1512 and the left sliding assembly 1514 serve to maintain a constant distance between the spool axle (not explicitly shown) and the brake-pawl axle 1511. Such an arrangement ensures that the brake-pawl assembly 1510 remains engaged to the first ratchet wheel 1516 and the second ratchet wheel 1518 thus preventing the inadvertent release of tension. The linear deflection of the spring 1620(1)-(2) can be measured using a scale 2010 (shown specifically in FIG. 15A) attached to an upper surface of the body 1502. The scale 2010, by way of example, is shown in FIG. 15A to be comprised of a reference marker 2012 applied to the upper surface of the left sliding assembly 1514 and a series of indicia 2014 applied to the upper surface of the body 1502. The position of the reference marker 2012 relative to the indicia 2014 indicates the degree of linear deflection of the spring 1620 (1)-(2). The magnitude of force applied can then be determined through the application of Hooke's Law ($F=-kx$), where F is the force applied, x is the linear deflection of the spring 1620(1)-(2) away from its equilibrium position, and k is a physical property of the spring 1620(1)-(2) known as the "force constant" or "spring constant." This property is commonly referred to as the "stiffness" of the spring 1620 (1)-(2). In one embodiment, the scale 2010 may simply measure deflection of the spring 1620(1)-(2), leaving the force to be computed by the operator using a known spring constant. However, in the preferred embodiment, the scale 2010 is calibrated to a particular spring 1620(1)-(2) to measure force as a function of deflection.

In the event that the operator desires to relieve tension applied to the wire 2004, the operator simply fully actuates the handle 1506 in the direction depicted by the arrow 2006. If a large magnitude of tension has been applied to the wire 2004, it may be necessary to actuate the drive-pawl assembly 1522 so as to disengage the drive-pawl assembly 1522 from the first ratchet wheel 1516 and the second ratchet wheel 1518. Such disengagement will allow the handle to rotate independently of the spool without applying any additional tension to the wire 2004. When the handle has been fully actuated in the direction depicted by the arrow 2006, the drive pawl contacts the brake-pawl assembly 1510. The interaction between the drive-pawl assembly 1522 and the brake-pawl assembly 1510 causes the brake-pawl assembly 1510 to also become disengaged from the first ratchet wheel 1516 and the second ratchet wheel 1518. The disengagement of both the drive-pawl assembly 1522 and the brake-pawl assembly 1510 allows the spool 1504 to rotate freely and relieves tension applied to the wire 2004.

Figure 20:
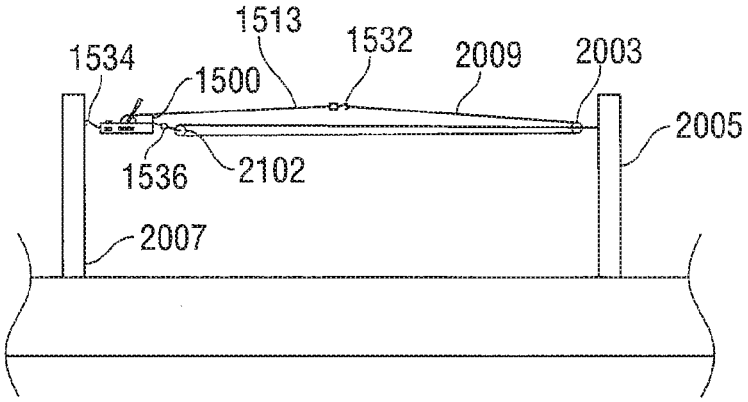
FIG. 20 is a schematic diagram illustrating operation of the mechanical winch of FIG. 15A.

FIG. 20 is a schematic diagram of illustrating operation of the mechanical winch 1500. In various embodiments, it is desirable to utilize the mechanical winch 1500 in conjunction with a block-and-tackle pulley system. In such an arrangement, a first pulley 2102 is connected with the third connector 1536. A second pulley 2003 is connected to an object such as, for example, a second fence post 2005. The second connector 1534 is attached to a support such as, for example, a first fence post 2007. The first connector 1532 is attached to a cable or other tensionable element 2009. The cable or other tensionable element 2009 is wound around the first pulley 2102 and the second pulley 2003. In various alternative embodiments, the tether 1513 may be wound around the first pulley 2102 and the second pulley 2003.

It is further contemplated that the spring 1620(1)-(2) may be interchangeable to allow use of the mechanical winch 1500 with springs of varying stiffness. This functionality allows the mechanical winch 1500 to measure a wider range of force, and adapts the device for use in a wide array of applications. Interchanging the spring 1620(1)-(2) may be accomplished through any appropriate means, but as currently contemplated, may be accomplished by removing the right sliding assembly 1512, the left sliding assembly 1514, and the spring-cup assembly 1618(1)-(2).

Figure 21:
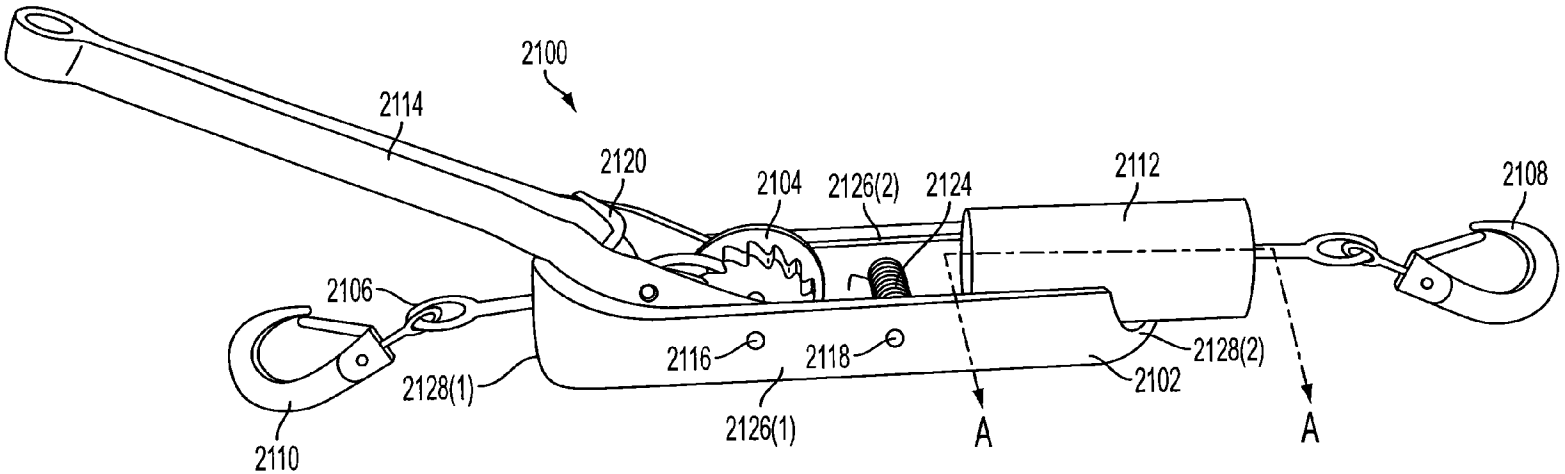
FIG. 21 is a perspective view of a fourth embodiment of a mechanical winch.

FIG. 21 is a perspective view of a fourth embodiment of a mechanical winch 2100. The mechanical winch 2100 includes a body 2102, a spool 2104 disposed within the body 2102, a tether 2106 coupled to, and wound around the spool 2104. A cylinder 2112 is coupled to the body 2102. A first connector 2108 is coupled to the cylinder 2112 and a second connector 2110 is coupled to the tether 2106. In a typical embodiment, the mechanical winch 2100 also includes a handle 2114, a spool axle 2116, a brake axle 2118, a drive pawl 2120, a brake pawl 2122 (shown in FIGS. 22-23), and a brake pawl spring 2124.

The body 2102 may be constructed of any durable material such as, for example, steel, aluminum, iron, and the like. For example, the body 2102 may be constructed of a strip of ⅛ inch thick cold rolled steel that is approximately 1.5 inches wide and approximately 28 ⅜ inches long. In other embodiments, the body 2102 may be constructed of, or coated with, a non-electrically-conductive material such as, for example, Kevlar, fiberglass, and the like. The body 2102 is formed into a roughly ovoid shape having parallel sides 2126(1)-(2), and ends 2128(1)-(2). Alternatively, the body 2102 may be formed by joining the parallel sides 2126(1)-(2) to ends 2128(1)-(2) through a process such as, for example, welding. Although, the body 2102 is depicted by way of example as being roughly ovoid, the body 2102 may be formed into any other appropriate shape depending on design requirements, such as, for example, rectangular, trapezoidal, or the like.

The first connector 2108 is connected to the cylinder 2112. In addition, the second connector 2110 is connected to a free end of the tether 2106. The tether 2106 is secured to, and wrapped around, the spool 2104. In various embodiments, a cable guide (not explicitly shown) is attached to the end 2128(1). The tether 2106 is stretched over the end 2128(1) and passes through the cable guide.

Figure 22:
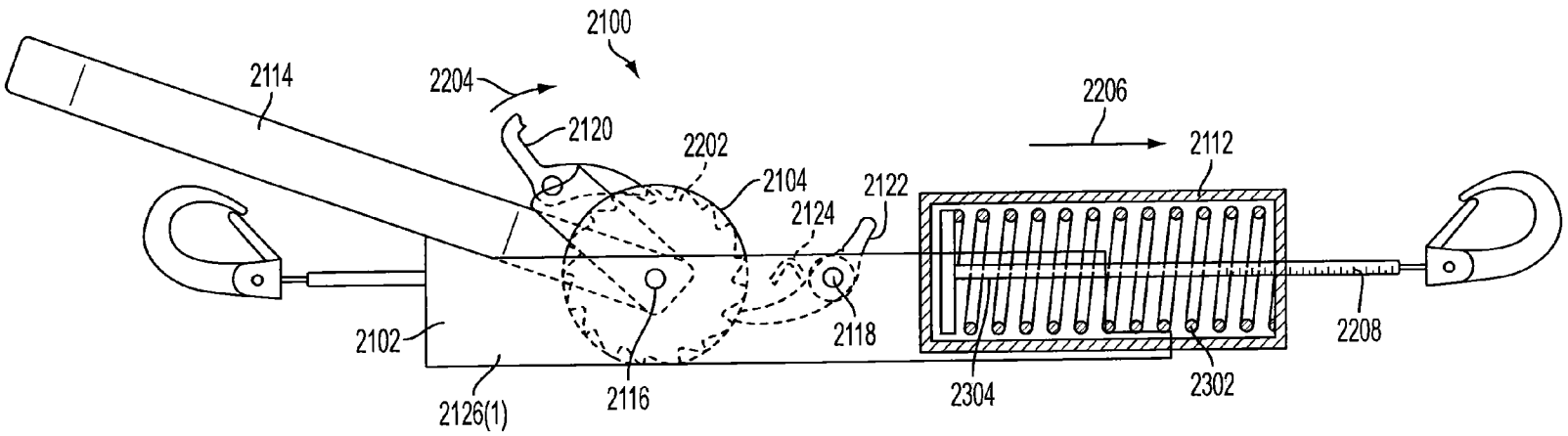
FIG. 22 is a side elevation view of the mechanical winch of FIG. 21 showing a cylinder in cross section.

FIG. 22 is a side elevation view of the mechanical winch 2100 showing the cylinder 2112 in cross section. In a typical embodiment, the spool 2104 includes a ratchet wheel 2202 disposed on a side thereof. The spool 2104 is shown by way of example in FIG. 22 to be disposed between opposite sides of the handle 2114 and is rotatably secured thereto by the spool axle 2116. However, in other embodiments, the spool 2104 may be secured to the handle 2114 in any appropriate arrangement. The spool axle 2116 further secures the spool 2104 to the body 2102. The handle 2114 includes the drive pawl 2120 for engaging the ratchet wheel 2202 in such a way so as to impart motion to the spool 2104 when the handle 2114 is rotated a direction denoted by arrow 2204.

The brake axle 2118 is disposed between the parallel sides 2126(1) and 2126(2) (shown in FIG. 21) of the body 2102 at a position proximal to the spool axle 2116. The brake pawl 2122 and the brake pawl spring 2124 are disposed on the brake axle 2118. The brake pawl spring 2124 functions to keep the brake pawl 2122 operatively engaged to the ratchet wheel 2202 so as to prevent unwinding of the spool 2104 when pressure on the handle 2114 is released. The brake pawl spring 2124 ensures that the brake pawl 2122 is biased to engage the ratchet wheel 2202.

Figure 23:
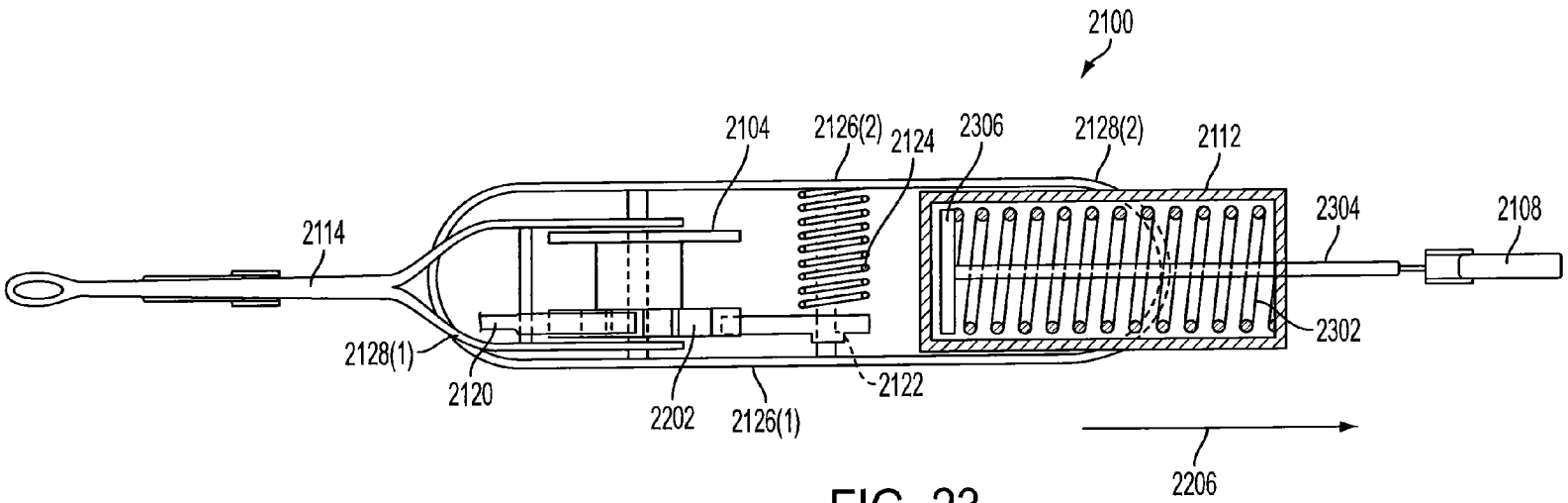
FIG. 23 is a top plan view of the mechanical winch of FIG. 21 showing the cylinder in cross section.

FIG. 23 is a top plan view of the mechanical winch 2100 showing the cylinder 2112 in cross section. The cylinder 2112 is affixed to the end 2128(2) of the body 2102. In a typical embodiment, the cylinder 2112 includes a spring 2302, a piston 2304, and a piston head 2306. In a typical embodiment, the piston 2304 is at least partially disposed within the cylinder 2112. The piston head 2306 is affixed to an end of the piston 2304 within the cylinder 2112. In a typical embodiment, the spring 2302 is entirely contained within the cylinder 2112. The spring 2302 is disposed around the piston 2304 such that a first end of the spring 2302 engages the piston head 2306 and a second end of the spring 2302 engages the cylinder 2112. In a typical embodiment, the first connector 2108 is operatively connected to a portion of the piston 2304 outside of the cylinder 2112.

Figure 24:
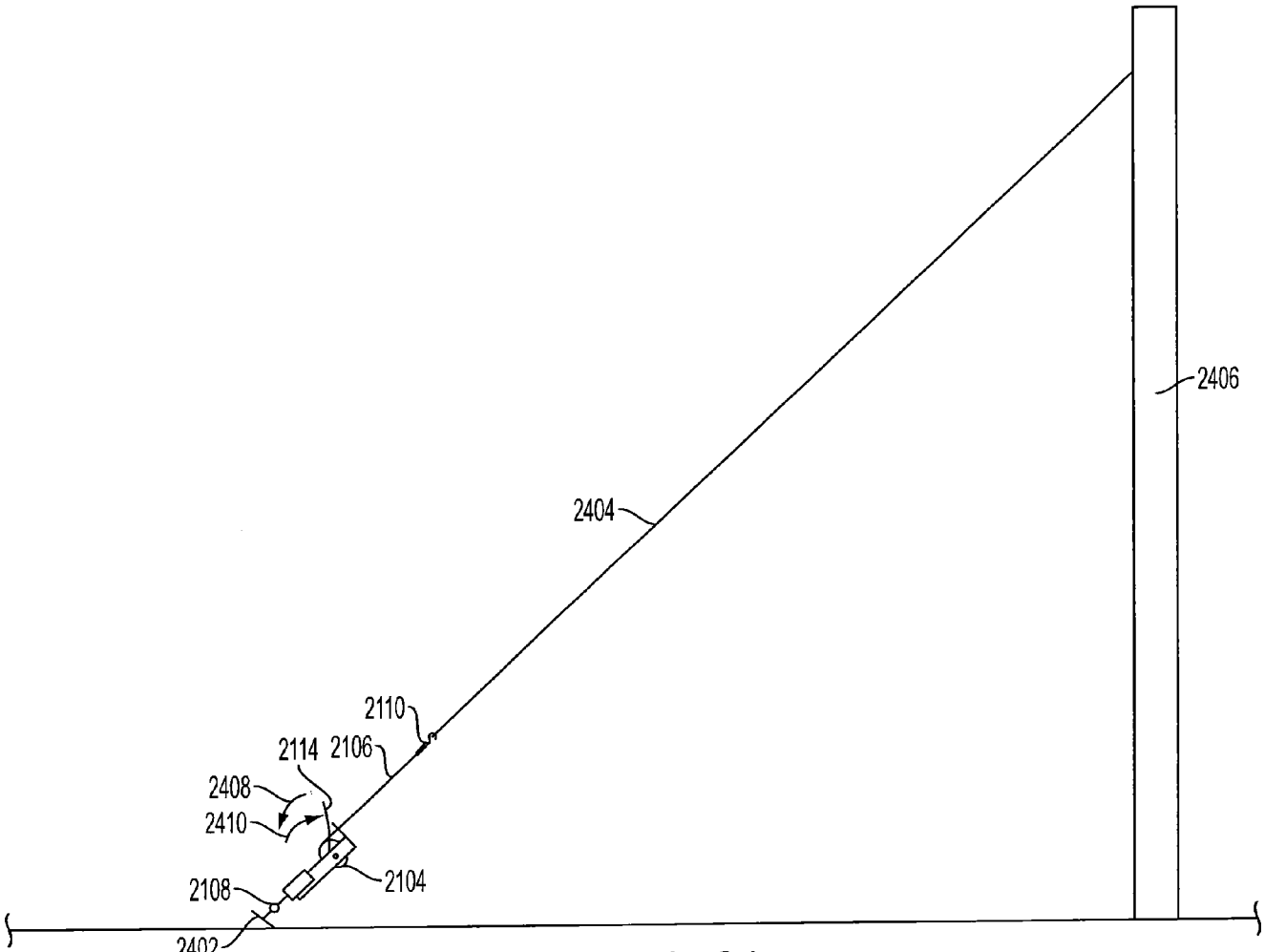
FIG. 24 is a schematic diagram illustrating operation of the mechanical winch of FIG. 21.

FIG. 24 is a schematic diagram illustrating operation of the mechanical winch 2100. During operation, the first connector 2108 is first connected to a stable support, shown by way of example in FIG. 25 to be an anchoring stake 2402. The second connector 2110 is attached to a length of cable, wire, or other tensionable element. By way of example, the second connector 2110 is shown attached to a length of wire 2404 similar to that used as, for example, a guide wire for a tower 2406. When the handle 2114 is actuated in the direction noted by arrow 2408, the drive pawl 2120 (shown in FIG. 21) engages the ratchet wheel 2202 (shown in FIG. 22), and causes the spool 2104 to rotate in the same direction as the handle 2114. As the spool 2104 rotates, the tether 2106 is wound around the spool 2104. When the handle 2114 is actuated in a direction noted by arrow 2410, the drive pawl 2120 does not engage, and does not impart any motion to, the ratchet wheel 2202. In this situation, the brake pawl 2122 (shown in FIG. 22) engages the ratchet wheel 2202, and prevents the spool 2104 from unwinding and releasing the tension on the tether 2106. Thus, repeated arcuate movements of the handle 2114 results in the tether 2106 becoming increasingly wound around the spool 2104 and incrementally greater tension being applied to the wire 2404.

Referring now to FIGS. 21-24, as a magnitude of tension applied to the wire 2404 increases, the spring 2302 is compressed within the cylinder 2112 in a direction denoted by arrow 2206 (shown in FIGS. 22-23). In various embodiments, linear deflection of the spring 2302 can be measured using indicia 2208 (shown in FIG. 22) disposed on the piston 2304. The magnitude of force applied to the wire 2404 can then be determined through application of Hooke's Law: $F=-kx$, where F is the force applied to the tether 2106, x is the linear deflection of the spring 2302 away from its equilibrium position, and k is a physical property of the spring 2302 known as the "force constant" or "spring constant." This property is commonly referred to as the "stiffness" of the spring 2302. In one embodiment the indicia 2208 may simply measure deflection of the spring 2302 leaving the force to be computed by an operator using a known spring constant. However, in the preferred embodiment, a scale is calibrated to a particular spring to measure force as a function of deflection.

In the event that the operator desires to relieve tension applied to the wire 2404, the operator fully actuates the handle 2114 in the direction depicted by the arrow 2408. If a large amount of tension has been applied to the wire 2404, it may be necessary to actuate the drive pawl 2120 so as to disengage the drive pawl 2120 from the ratchet wheel 2202. Such disengagement will allow the handle to rotate independently of the spool without applying any additional tension to the wire 2404. When the handle has been fully actuated in the direction depicted by the arrow 2408, the drive pawl contacts the brake pawl 2122. The interaction between the drive pawl 2120 and the brake pawl 2122 causes the brake pawl 2122 to also become disengaged from the ratchet wheel 2202. The disengagement of both the drive pawl 2120 and the brake pawl 2122 allows the spool 2104 to rotate freely and relieves tension applied to the wire 2404.

Figure 25A:
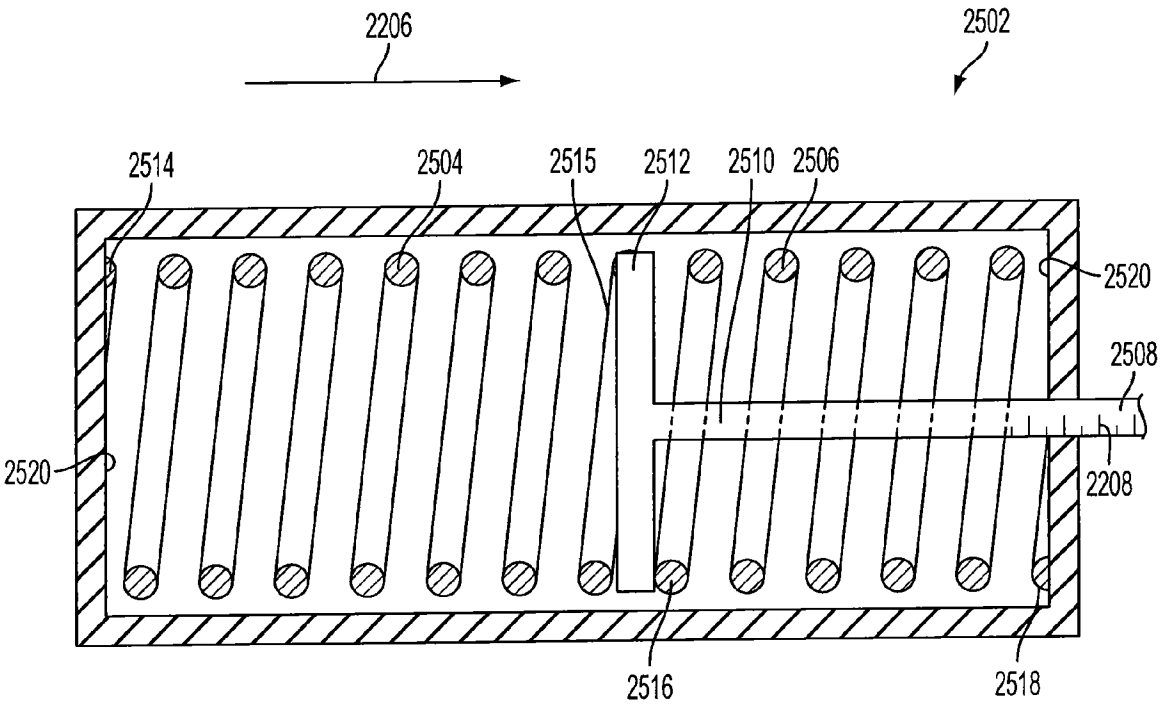
FIGS. 25A-25B are side cross-sectional views of a cylinder for use with the mechanical winch of FIG. 21.

FIG. 25A is a side cross-sectional view, taken along line A-A shown in FIG. 21, of a cylinder 2502. The cylinder 2502 includes a first spring 2504, a second spring 2506, and a piston 2508. The piston 2508 includes an axle 2510 and a piston head 2512. The first spring 2504 is disposed within the cylinder 2502 such that a first end 2514 of the first spring 2504 is operatively connected to an inner wall 2520 of the cylinder 2502 and a second end 2515 end of the first spring 2504 is operatively connected to the piston head 2512. The second spring 2506 is disposed within the cylinder 2502 such that a first end 2516 of the second spring 2506 engages the piston head 2512 and a second end 2518 of the second spring 2506 engages the inner wall 2520 of the cylinder 2502.

During operation, as a magnitude of tension applied to the wire 2404 (shown in FIG. 24) increases, the first spring 2504 is placed in tension and the second spring 2506 is compressed within the cylinder 2502 in a direction denoted by arrow 2206. The interaction of the first spring 2504 and the second spring 2506 yields a higher effective spring constant (k) thus enabling the mechanical winch 2100 to accurately measure tensions of higher magnitude. In a typical embodiment, displacement of the piston 2508 may be measured using the indicia 2208 disposed on the axle 2510.

Figure 25B:
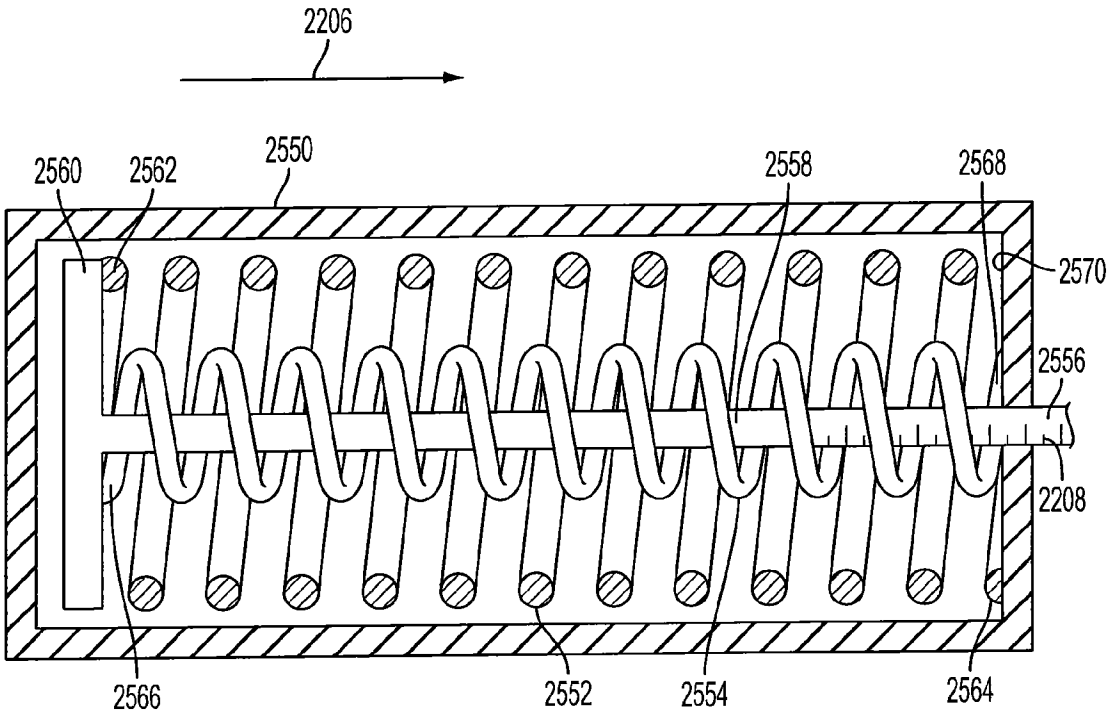

FIG. 25B is a side cross-sectional view of a cylinder 2550. The cylinder 2550 includes a first spring 2552, a second spring 2554, and a piston 2556. In a typical embodiment, the piston 2556 includes an axle 2558 and a piston head 2560. The first spring 2552 is disposed within the cylinder 2550 such that a first end 2562 of the first spring 2552 engages the piston head 2560 and a second end 2564 of the first spring 2552 engages an inner wall 2570 of the cylinder 2550. The second spring 2554 is disposed within the cylinder 2550 and within the first spring 2552 such that a first end 2566 of the second spring 2554 engages the piston head 2560 and a second end 2568 of the second spring 2554 engages the inner wall 2570 of the cylinder 2550. In a typical embodiment, displacement of the piston 2556 may be measured using the indicia 2208 disposed on the axle 2558. In various embodiments, cylinders such as, for example the cylinder 2550 and the cylinder 2502 may be utilized in lieu of the cylinder 2112 shown in FIG. 21.

During operation, as a magnitude of tension applied to the wire 2404 (shown in FIG. 24) increases, the first spring 2552 and the second spring 2554 are compressed within the cylinder 2550 in a direction denoted by arrow 2206. The interaction of the first spring 2552 and the second spring 2554 yields a higher effective spring constant (k) thus enabling the mechanical winch 2100 to accurately measure tensions of higher magnitude.

Figure 26:
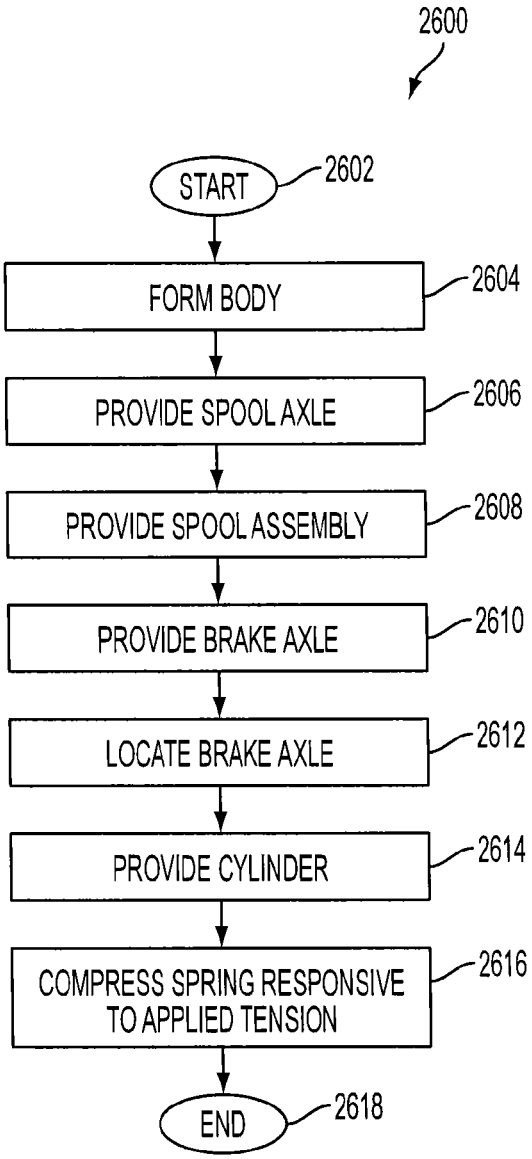
FIG. 26 is a flow diagram illustrating a process for manufacturing the mechanical winch of FIG. 21.

FIG. 26 is a flow diagram illustrating a process for manufacturing a mechanical winch. A process 2600 begins at step 2602. At step 2604 the body 2102 is formed. At step 2606, a spool axle is provided and placed within the body 2102. At step 2608, the spool 2104 is provided and located about the spool axle 2116. At step 2610, the brake axle 2118 is provided and placed within the body 2102. At step 2612, the brake axle 2118 is located a fixed distance from the spool axle 2116. At step 2614, the cylinder 2112 containing the spring 2302 is provided and attached to the body 2102. At step 2616, actuation of the spool 2104 applies increasing tension to the tether 2106 and compresses the spring 2302. The process 2600 ends at step 2618. While the process 2600 is described with respect to the mechanical winch 2100, it is understood that other embodiments described herein may be similarly manufactured.

Figure 27:
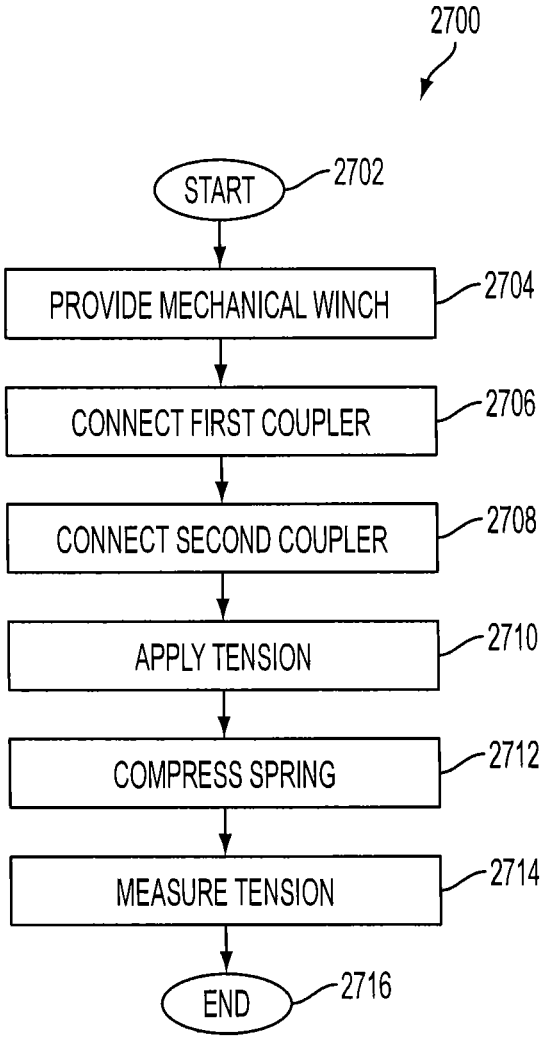
FIG. 27 is a flow diagram illustrating a process for tensioning a tensionable element utilizing the mechanical winch of FIG. 21.

FIG. 27 is a flow diagram illustrating a process for tensioning a tensionable element utilizing the mechanical winch 2100. A process 2700 begins at step 2702. At step 2704, the mechanical winch 2100 is provided. At step 2706, the first connector 2108 is attached to a fixed support. At step 2708, the second connector 2110 is attached to a tensionable element. At step 2710, tension is applied to the tensionable element through actuation of the mechanical winch 2100. At step 2712, the spring 2302 disposed within a cylinder is compressed responsive to applied tension. At step 2714, applied tension is measured as a function of compression of the spring 2302. The process 2700 ends at step 2716.

Figure 28A:
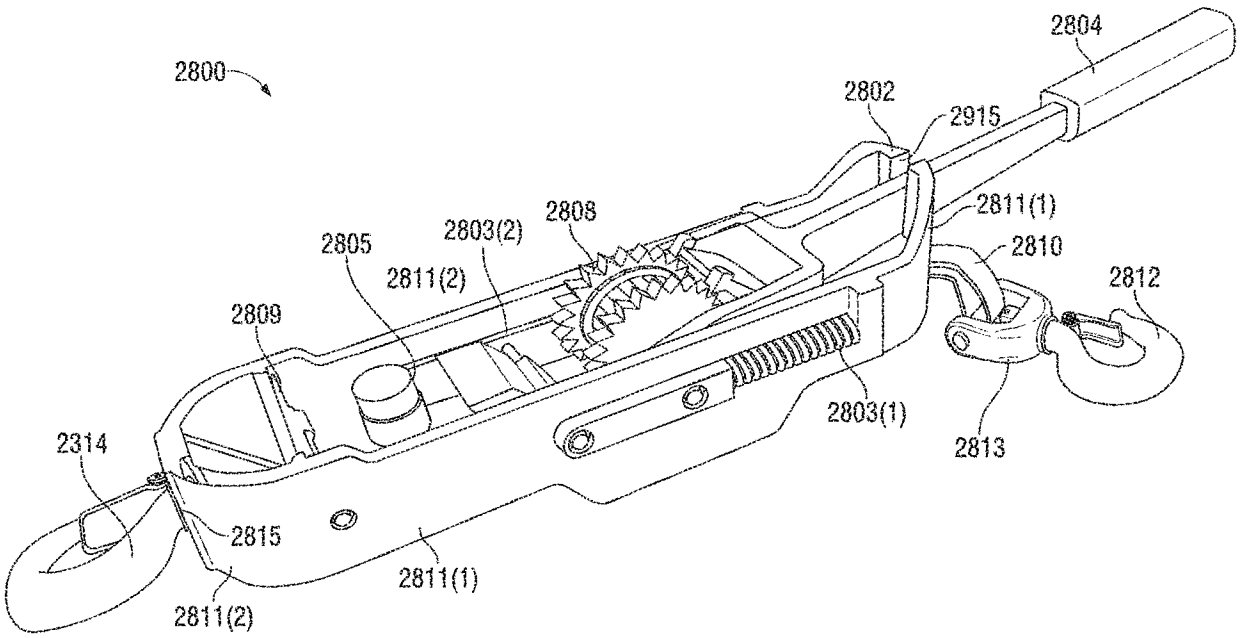
FIG. 28A is a perspective view of a top aspect of a mechanical winch.
Figure 28B:
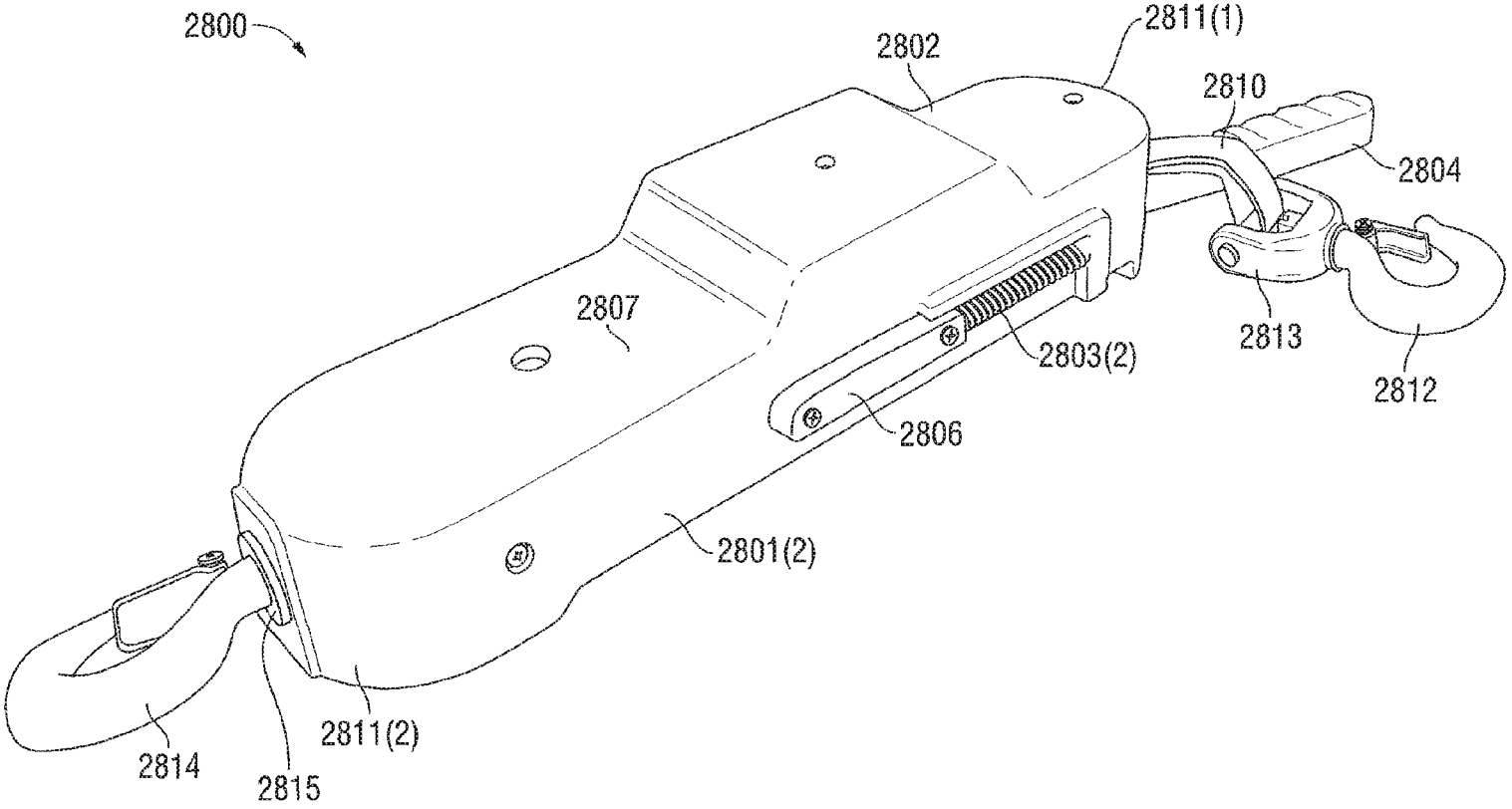
FIG. 28B is a perspective view of a bottom aspect of the mechanical winch of FIG. 1A.

FIG. 28A is a perspective view of a top aspect of a mechanical winch 2800. FIG. 28B is a perspective view of a bottom aspect of the mechanical winch 2800. Referring to FIGS. 28A and 28B, the mechanical winch 2800 includes a body 2802, a handle 2804 pivotably coupled to the body 2802, an indicator assembly 2809 disposed in the body 2802, and a spool-support assembly 2806 slidably disposed within the body 2802. A spool 2808 is rotatably disposed within the spool-support assembly 2806 and a tether 2810 secured about the spool 2808. A first connector 2812 is coupled to the tether 2810 and a second connector 2814 is coupled to the body 2802.

In a typical embodiment, the body 2802 and the handle 2804 are constructed of a non-electrically-conductive material such as, for example, plastic, Kevlar, fiberglass, or another non-electrically-conductive material. Use of such non-electrically-conductive material allows the mechanical winch 2800 to be utilized in applications involving tensioning of electrically-charged objects such as, for example, electrical-transmission wires and the like. The body 2802 is formed into a substantially ovoid shape having generally parallel sides 2801(1) and 2801(2) and rounded ends 2811(1) and 2811(2). In other embodiments, mechanical winches utilizing principles of the invention may include a body formed into any other appropriate shape, such as, for example, rectangular and the like. A first slot 2801(1) is formed on the generally parallel side 2801(1) and a second slot 2801(2) is formed on the generally parallel side 2801(2). The body 2802 includes a bottom face 2807 formed between the generally parallel sides 2801(1) and 2801(2) and the rounded ends 2811(1) and 2811(2). The bottom face 2807 imparts additional rigidity and strength to the body 2802.

The first connector 2812 is coupled to an end of the tether 2810 by a first swivel 2813 and the second connector 2814 is coupled to the rounded end 2811(2) by a second swivel 2815. In a typical embodiment, the first connector 2812 and the second connector 2814 are constructed of a non-electrically-conductive material such as, for example, plastic, Kevlar, fiberglass or other non-electrically-conductive material.

Figure 28C:
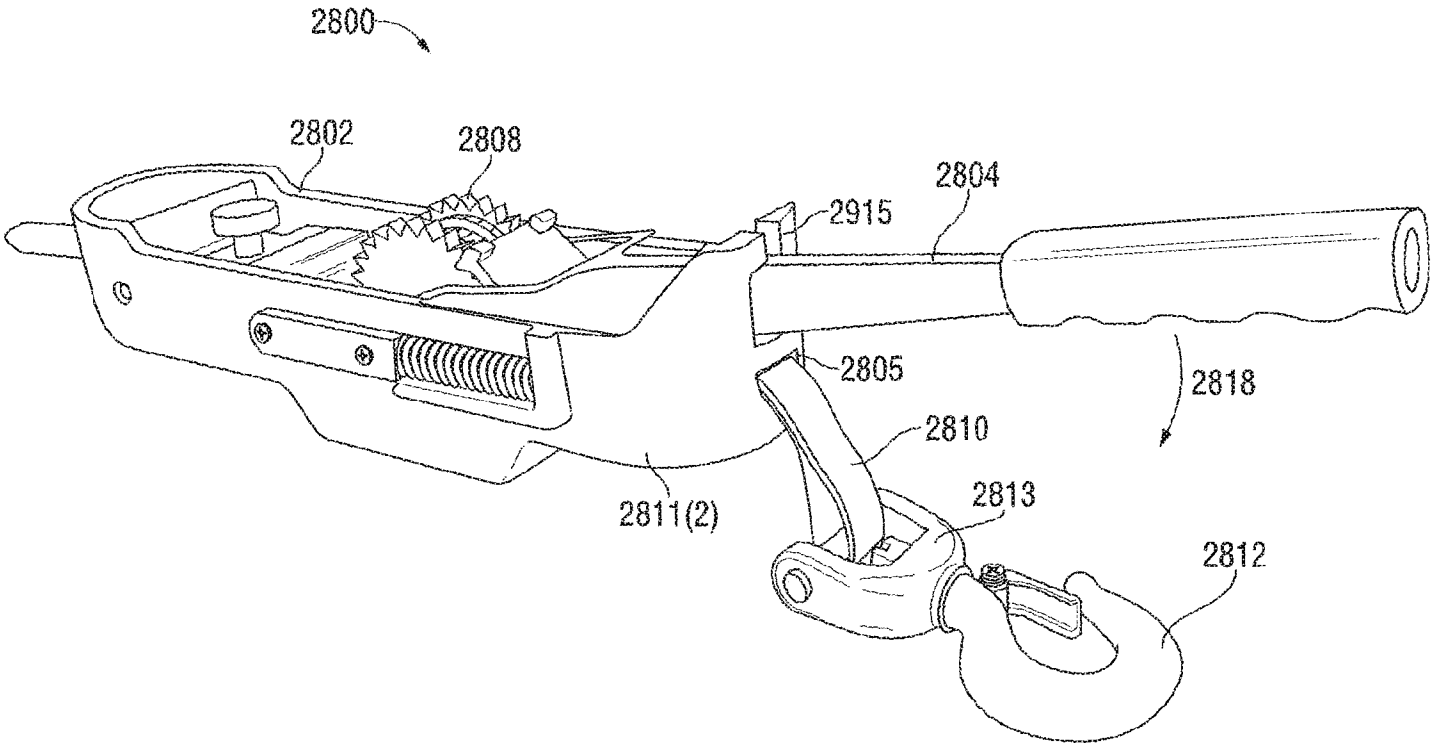
FIG. 28C is a perspective view of a distal end of the mechanical winch of FIG. 1A.

FIG. 28C is a perspective view of a distal end of the mechanical winch 2800. The handle 2804 may be actuated in a direction noted by the arrow 2817. When so actuated, the handle 2804 may be caused to engage a slot 2915 formed in the rounded end 2811(1) of the body 2802. Engagement of the handle 2804 with the slot 2915 allows the handle 2804 to be moved generally into approximate alignment with the body 2802 for ease of storage and transport. The tether 2810, which is typically constructed of a non-absorbent, non-electrically-conductive material, is secured about the spool 2808. In a typical embodiment, the tether 2810 may comprise, for example, a cable, a wire, a rope, a strap, or the like. The tether 2810 passes through an opening 2805 formed in the rounded end 2811(1).

The non-electrically-conductive aspects of the tether 2810 have been further defined in light of recent testing. Recent tests have shown that an exemplary tether, having a width of 1 inch, a length of 10 feet, and a thickness of 1/16 inch, in dry conditions, exhibits a current leakage of approximately 40 μA or less when a test voltage of approximately 100kV is applied over a period of approximately five minutes. It has been shown however, that the tether 2810, in wet conditions, may absorb moisture. Such moisture increases the exhibited current leakage and reduces the insulating capacity of the tether 2810. Thus, in accordance with the principles of the present invention, it is contemplated to coat the tether 2810 with a moisture-resistant non-absorbant coating such as, for example, teflon or other hydrophobic water-resistant substance. Such a coating will allow the tether 2810 to maintain non-conductive properties during wet conditions.

Figure 29A:
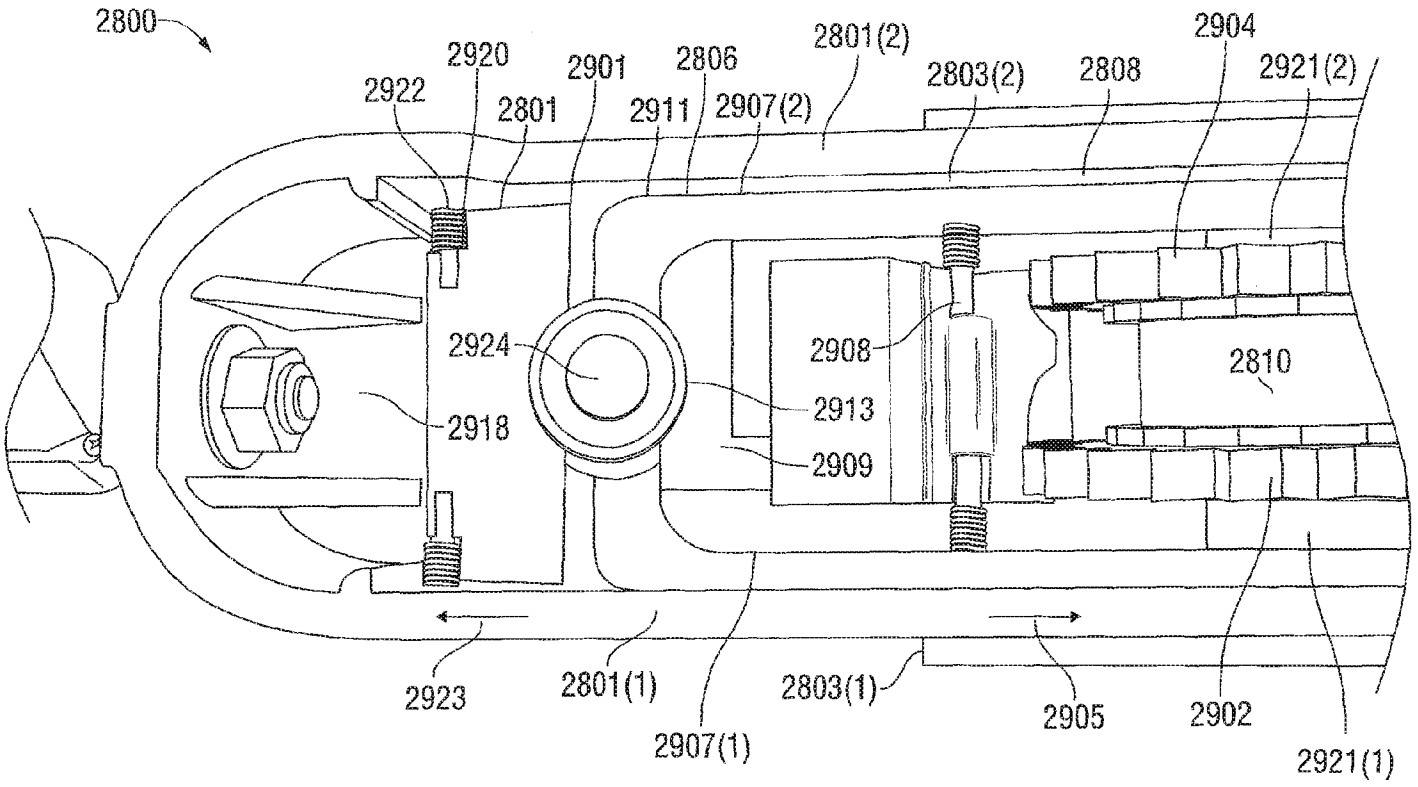
FIG. 29A is a detailed partial top view illustrating a proximal aspect of the mechanical winch of FIG. 1A.

FIG. 29A is a detailed partial top view illustrating a proximal aspect of the mechanical winch 2800. The spool 2808 includes a first ratchet wheel 2902 and a second ratchet wheel 2904 disposed on opposite sides of the spool 2808. The spool-support assembly 2806 includes a first side member 2907(1), a second side member 2907(2) oriented generally parallel to the first side member 2907(1), and a cross member 2909 disposed between, and coupled to, the first side member 2907(1) and the second side member 2907(2). At least a portion of the first side member 2907(1) is slidably disposed in the first slot 2801(1) and at least a portion of the second side member 2907(2) is slidably disposed in the second slot 2801(2).

The spool-support assembly 2806 includes an indicator dial 2924 disposed on the cross member 2909. The indicator dial 2924 has indicia printed thereon that are used to select a magnitude of tension to be applied to the tether 2810. An indicator lobe 2901 is disposed below the indicator dial 2924. The indicator lobe 2901 is cam-lobe shaped and includes an area of maximum width 2911 and an area of minimum width 2913 generally corresponding to the indicia printed on the indicator dial 2924.

The indicator assembly 2809 includes a third axle 2920 disposed between the generally parallel sides 2801(1) and 2801(2) at a position proximal to the cross member 2909 and adjacent to the indicator dial 2924. An indicator 2918 and an indicator spring 2922 of the indicator assembly 2809 are disposed on the third axle 2920. The indicator 2918 is biased by the indicator spring 2922 in a direction indicated by the arrow 2923. The indicator lobe 2901 engages the indicator 2918 and prevents the indicator 2918 from moving in the direction indicated by the arrow 2923. As a magnitude of tension applied to the tether 2810 increases, the spool-support assembly 2806 moves in the direction indicated by the arrow 2905. When the desired magnitude of tension is reached, the indicator lobe 2901 disengages from the indicator 2918, thereby allowing the indicator 2918 to rotate in the direction indicated by the arrow 2923. Movement of the indicator 2918 provides a visual indication that the desired magnitude of tension has been reached.

Figure 29B:
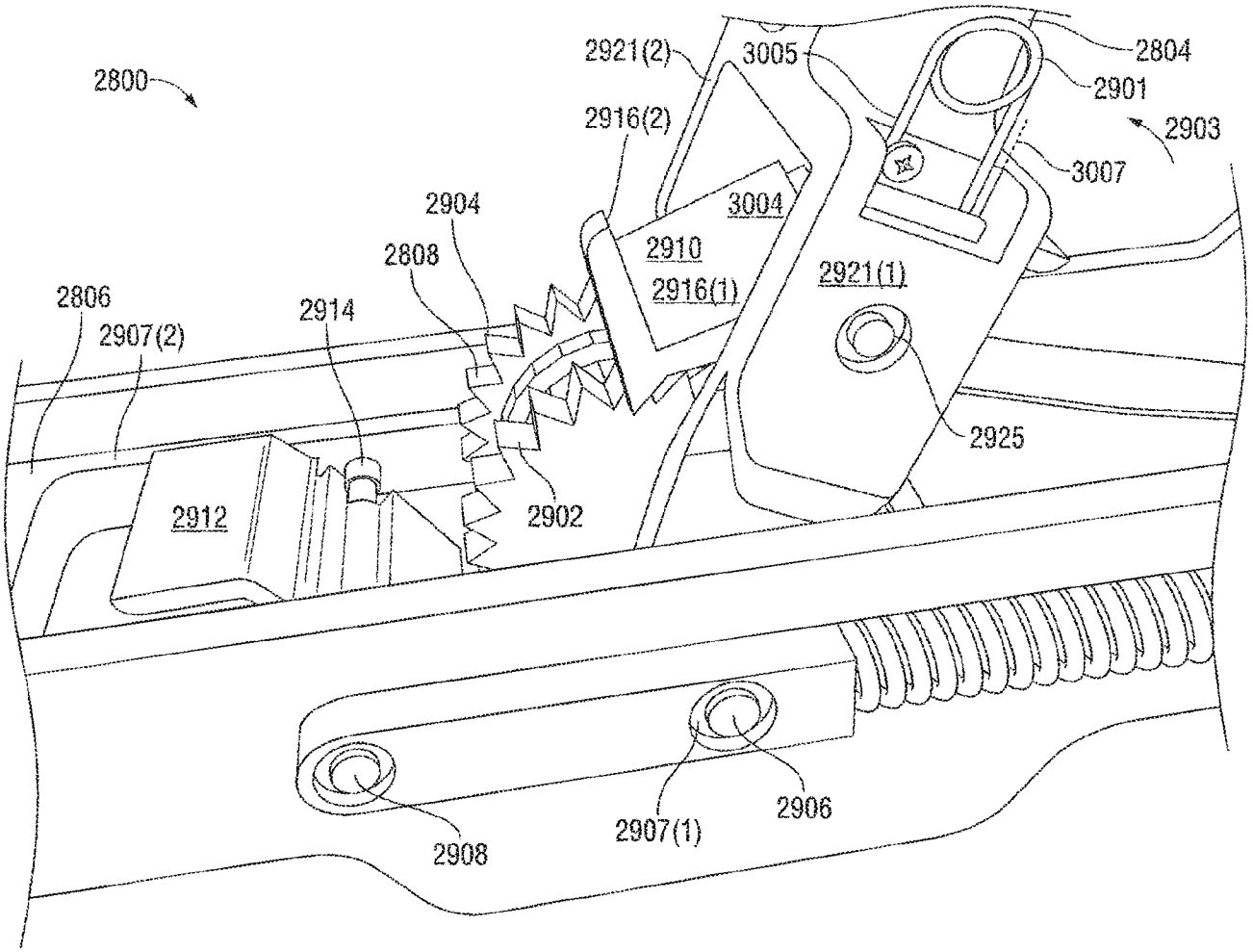
FIG. 29B is a detailed partial perspective view illustrating a central aspect of the mechanical winch of FIG. 1A.

FIG. 29B is a detailed partial perspective view illustrating a central aspect of the mechanical winch 2800. The spool-support assembly 2806 includes a first axle 2906 and a second axle 2908. The first axle 2906 and the second axle 2908 extend through the first side member 2907(1) and the second side member 2907(2). The first axle 2906 and the second axle 2908 are disposed generally parallel to each other between, and generally orthogonally to, the first side member 2907(1) and the second side member 2907(2).

The handle 2804 includes a pair of opposing arms 221(1) and 221(2) and a drive-pawl axle 2925 extending between, and generally orthogonally to, the pair of opposing arms 221(1) and 221(2). By way of example, the handle 2804 is depicted in FIGS. 28A-29B as being in a first position such that the handle 2804 is angled toward a distal end of the mechanical winch 2800. The spool 2808 and the handle 2804 are pivotably coupled to the spool-support assembly 2806 by the first axle 2906. The spool 2808 is disposed between the pair of opposing arms 221(1) and 221(2) of the handle 2804.

A drive pawl 2910 is disposed about the drive-pawl axle 2925 and between the pair of opposing arms 221(1) and 221(2). The drive pawl 2910 includes tabs 2916(1) and 2916(2). The tabs 2916(1) and 2916(2) are arranged on a face of the drive pawl 2910 opposite the first ratchet wheel 2902 and the second ratchet wheel 2904. A drive-pawl spring 3004 is disposed about the drive-pawl axle 2925 and serves to bias the drive pawl 2910 into engagement with the first ratchet wheel 2902 and the second ratchet wheel 2904.

A switch 3001 is coupled to the drive-pawl spring 3004. The switch 3001 is actuatable between a first position 3005 and a second position 3007. When the switch 3001 is in the first position 3005, the switch 3001 causes the drive-pawl spring 3004 to bias the drive pawl 2910 into engagement with the first ratchet wheel 2902 and the second ratchet wheel 2904. When the switch 3001 is in the second position 3007, the drive-pawl spring 3004 does not bias the drive pawl 2910 to engage the first ratchet wheel 2902 and the second ratchet wheel 2904. Interaction of the drive pawl 2910 with the first ratchet wheel 2902 and the second ratchet wheel 2904 imparts rotational motion about the first axle 2906 to the spool 2808 when the handle 2804 is actuated in the direction illustrated by the arrow 2903. Such rotational motion of the spool 2808 causes the tether 2810 to become increasingly wound around the spool 2808.

A brake pawl 2912 is disposed on the second axle 2908 between the first side member 2907(1) and the second side member 2907(2) at a position proximal to the first axle 2906. The brake pawl 2912 is biased to engage the first ratchet wheel 2902 and the second ratchet wheel 2904 by a brake-pawl spring 2914. Interaction of the brake pawl 2912 with the first ratchet wheel 2902 and the second ratchet wheel 2904 prevents unwinding of the spool 2808 when the handle 2804 is actuated in a direction opposite a direction illustrated by the arrow 2903.

Figure 30:
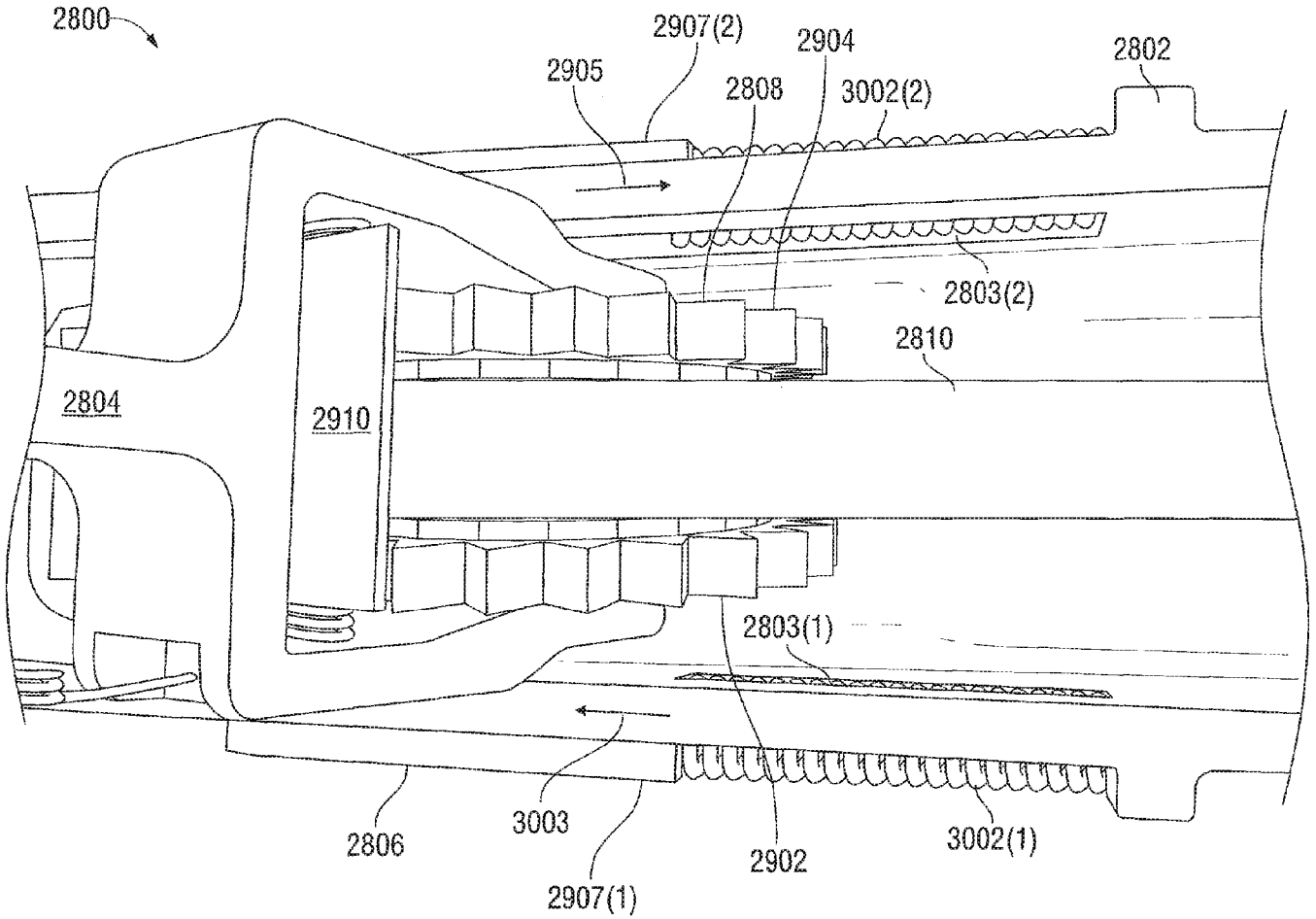
FIG. 30 is a detailed partial top view illustrating a distal aspect of the mechanical winch of FIG. 1A.

FIG. 30 is a detailed partial top view illustrating a distal aspect of the mechanical winch 2800. In FIG. 30, the handle 2804 has been partially actuated to a second position proximal to the first position illustrated in FIG. 29B. A first spring 3002(1) is disposed in the first slot 2801(1) and a second spring 3002(2) is disposed in the second slot 2801(2). The first spring 3002(1) engages the body 2802 and the first side member 2907(1), and the second spring 3002(2) engages the body 2802 and the second side member 2907(2). The first spring 3002(1) and the second spring 3002(2) bias the spool-support assembly 2806 in a direction indicated by the arrow 3003. In other embodiments, mechanical winches utilizing principles of the invention may include springs of various types such as, for example, a hydraulic cylinder, a Nitrogen-gas spring, or a die spring. In a typical embodiment, the first spring 3002(1) and the second spring 3002(2) are constructed of a non-electrically-conductive material such as, for example, Kevlar; however, in other embodiments, the first spring 3002(1) and the second spring 3002(2) may be constructed from other materials including, for example, metallic materials. In a typical embodiment, the first spring 3002(1) and the second spring 3002(2) are removable and interchangeable.

Referring now to FIGS. 29A-30, when the handle 2804 is rotated in the direction indicated by the arrow 2903, the drive pawl 2910 engages the first ratchet wheel 2902 and the second ratchet wheel 2904, thereby causing the spool 2808 to rotate. As the spool 2808 rotates, the tether 2810 becomes increasingly wound around the spool 2808, increasing a magnitude of tension applied to the tether 2810. As the magnitude of tension applied to the tether 2810 increases, the spool-support assembly 2806 moves in a direction indicated by the arrow 2905, compressing the first spring 3002(1) and the second spring 3002(2).

Figure 31:
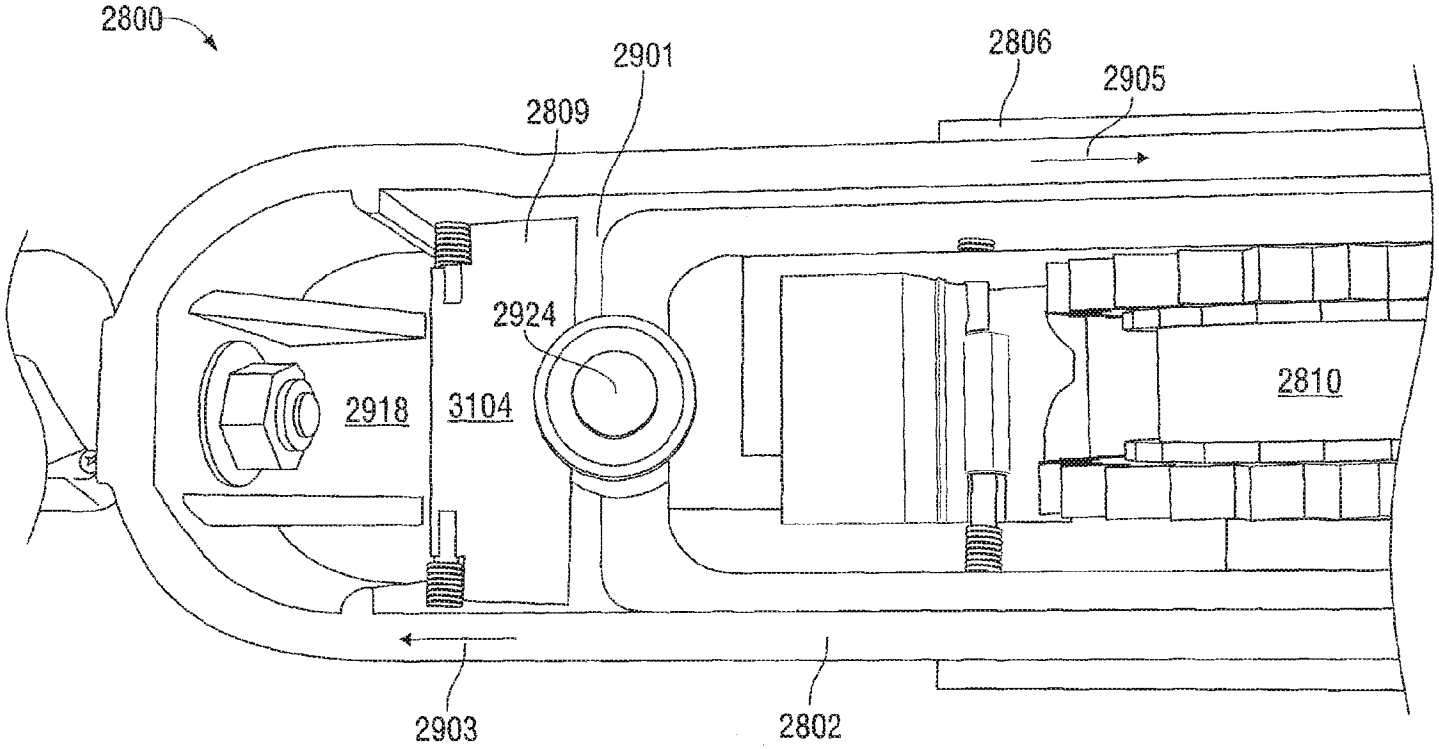
FIG. 31 is a detailed partial top view of the proximal aspect of the mechanical winch of FIG. 28A illustrating an indicator assembly.

FIG. 31 is a detailed partial top view of a proximal aspect of the mechanical winch 2800 and illustrating the indicator assembly 2809 in more detail. During operation, the indicator 2918 is rotated in a direction opposite the arrow 2923. The indicator dial 2924 is rotated until the desired magnitude of tension, as indicated by the indicia, aligns with a marker 3104 printed on the indicator 2918. Rotation of the indicator dial 2924 increases or decreases an exposed width of the indicator lobe 2901, thereby adjusting a magnitude of tension required to disengage the indictor 2918 from the indicator lobe 2901. By way of example, if a large amount of tension is to be applied to the tether 2810, the indictor dial 2924 may be adjusted to expose a greater width of the indictor lobe 2901. On the other hand, if a small amount of tension is to be applied to the tether 2810, the indictor dial 2924 may be adjusted to expose a shorter width of the indicator lobe 2901.

The indicator lobe 2901 engages the indicator 2918 and prevents the indicator 2918 from moving in the direction indicated by the arrow 2923. As a magnitude of tension applied to the tether 2810 increases, the spool-support assembly 2806 moves in the direction indicated by the arrow 2905. When the desired magnitude of tension is reached, the indicator lobe 2901 disengages from the indicator 2918, thereby allowing the indicator 2918 to rotate in the direction indicated by the arrow 2923. Movement of the indicator 2918 provides a visual indication that the desired magnitude of tension has been reached. In other embodiments, a chime may be coupled to the body 2802. In such embodiments, the indicator 2918 strikes the chime upon becoming disengaged from the indicator lobe 2901 and causes the chime to emit an audible tone that signals that the desired level of tension has been reached.

Figure 32:
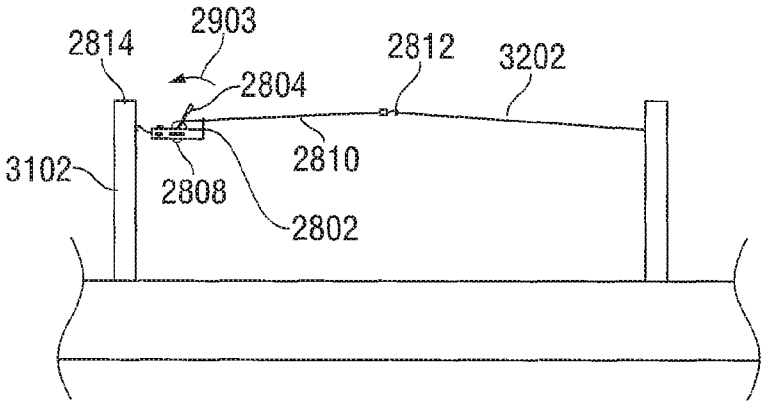
FIG. 32 is a schematic diagram illustrating operation of the mechanical winch of FIG. 28A.

FIG. 32 is a schematic diagram that illustrates operation of the mechanical winch 2800. The second connector 2814 is coupled to a support, shown by way of example in FIG. 32 to be a fence post 3201. The first connector 2812 is coupled to a length of cable, wire, or other tensionable element to be tensioned. By way of example, the first connector 2812 is shown coupled to a length of wire 3202.

Referring now to FIGS. 28A-32, when the handle 2804 is actuated in the direction noted by arrow 2903, the drive pawl 2910 engages the first ratchet wheel 2902 and the second ratchet wheel 2904 and causes the spool 2808 to rotate in the same direction as the handle 2804. As the spool 2808 rotates, the tether 2810 is wound around the spool 2808. When the handle 2804 is actuated in a direction opposite that illustrated by the arrow 2903, the drive pawl 2910 does not engage, and does not impart motion to, the first ratchet wheel 2902 and the second ratchet wheel 2904. In this situation, the brake pawl 2912 engages the first ratchet wheel 2902 and the second ratchet wheel 2904, and prevents the spool 2808 from unwinding. Repeated arcuate movements of the handle 2804 result in the tether 2810 becoming increasingly wound around the spool 2808 and incrementally greater tension being applied to the length of wire 3202.

s a magnitude of tension applied to the length of wire 3202 increases, the spool-support assembly 2806 slides within the body 2802 in the direction denoted by arrow 2905. This motion compresses the first spring 3002(1) and the second spring 3002(2). As the spool-support assembly 2806 slides in the direction denoted by the arrow 2905, a constant distance is maintained between the first axle 2906 and the second axle 2908. Such an arrangement ensures that the brake pawl 2912 remains engaged to the first ratchet wheel 2902 and the second ratchet wheel 2904, thus preventing inadvertent release of tension.

The magnitude of tension applied to the length of wire 3202 is determined through application of Hooke's Law ($F=-kx$), where F is a force applied, x is a linear deflection of the first spring 3002(1) and the second spring 3002(2) away from an equilibrium position, and k is a physical property of the first spring 3002(1) and the second spring 3002(2) known as a "force constant" or "spring constant." This property is commonly referred to as a "stiffness" of the first spring 3002(1) and the second spring 3002(2). The indicia is calibrated to the first spring 3002(1) and the second spring 3002(2) to measure tension as a function of deflection of the first spring 3002(1) and the second spring 3002(2).

When an operator desires to relieve tension applied to the length of wire 3202, the operator moves the switch 3001 to the second position 3007, thus disengaging the drive pawl 2910 from the first ratchet wheel 2902 and the second ratchet wheel 2904. The operator then fully actuates the handle 2804 in the direction of the arrow 2903. Responsive to the handle 2804 having been fully actuated in the direction of the arrow 2903, the tabs 2916(1) and 2916(2) on the drive pawl 2910 engage the brake pawl 2912. Engagement of the tabs 2916(1) and 2916(2) and the brake pawl 2912 presses the drive pawl 2910 into engagement with the first ratchet wheel 2902 and the second ratchet wheel 2904 and causes the brake pawl 2912 to become disengaged from the first ratchet wheel 2902 and the second ratchet wheel 2904.

Disengagement of the brake pawl 2912 from the first ratchet wheel 2902 and the second ratchet wheel 2904 frees the spool 2808 to rotate responsive to the handle 2804 subsequently being actuated in the direction opposite the arrow 2903. Such rotation of the spool 2808 allows the tether 2810 to be unwound an incremental and controlled amount that approximately corresponds to a distance between adjacent ratchets on the first ratchet wheel 2902 and the second ratchet wheel 2904. As the handle 2904 moves in the direction opposite the arrow 2903, the tabs 2916(1) and 2916(2) disengage the brake pawl 2912. Disengagement of the tabs 2916(1) and 2916(2) from the brake pawl 2912 allows the brake pawl 2912 to re-engage the first ratchet wheel 2902 and the second ratchet wheel 2904, thereby preventing additional rotation of the spool 2808 in the direction opposite the arrow 2903, such that additional payout of the tether 2810 is prevented. Reciprocal movement of the handle 2904 in the direction of the arrow 2903 permits ratcheted, incremental, and controlled unwinding of the tether 2810 to be achieved. Such unwinding of the tether 2810 incrementally pays out the tether 2810 and relieves tension applied to the length of wire 3202.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A mechanical winch comprising:

a body;

a spool axle slidably disposed within the body and coupled to the body by at least one spring;

a spool disposed about the spool axle;

a handle pivotably coupled to the body and operable to impart force to the spool so as to induce rotation of the spool;

a non-electrically-conductive tether coupled to the spool;

a brake axle slidably disposed within the body and located a fixed distance from the spool axle;

an adjustable stop slidably disposed within the body, the adjustable stop comprising an indicator dial having indicia printed thereon;

an indicator lobe disposed below the indicator dial, the indicator lobe including an area of maximum width and an area of minimum width generally corresponding to the indicia;

a spring-biased indicator disposed within the body generally parallel to the spool axle, the spring-biased indicator being removably engaged with the adjustable stop, wherein, responsive to a desired magnitude of tension being reached, the spring-biased indicator becomes disengaged from the adjustable stop; and wherein actuation of the handle applies increasing tension to the non-electrically-conductive tether and causes compression of the at least one spring.

2. The mechanical winch of claim 1, wherein the spool axle and the brake axle are coupled to a spool-support assembly slidably disposed in the body.

3. The mechanical winch of claim 1, wherein an exposed area of the indicator lobe is varied via actuation of the indicator dial.

4. The mechanical winch of claim 1, wherein the at least one spring comprises at least one of a die spring, a hydraulic cylinder, and a nitrogen gas spring.

5. A mechanical winch comprising:

a body;

a spool-support assembly slidably disposed within the body;

a spool rotatably coupled to the spool-support assembly;

a tether secured around the spool;

an adjustable stop coupled to the spool-support assembly, the adjustable stop comprising an indicator lobe, the indicator lobe including an area of maximum width and an area of minimum width;

a selection member disposed on the spool-support assembly and interoperably coupled to the adjustable stop, the selection member comprising an indicator dial disposed above the indicator lobe and having indicia printed thereon, wherein the selection member allows selection of a desired magnitude of tension to be applied to the tether;

a handle pivotably coupled to the body and operable to induce rotation of the spool to apply a tension to the tether;

a spring operatively engaged with the body and the spool-support assembly;

a spring-biased indicator disposed in the body generally parallel to an axis of rotation of the spool, the spring-biased indicator being removably engaged with the adjustable stop;

wherein the tension applied to the tether causes displacement of the spool-support assembly and causes compression of the spring; and wherein, responsive to the desired magnitude of tension being reached, the spring-biased indicator becomes disengaged from the adjustable stop.

6. The mechanical winch of claim 5, wherein the body, the tether, and the handle are constructed of an electrically-non-conductive material.

* * * * *